United States Patent [19]

Baena

[11] Patent Number: 4,741,135

[45] Date of Patent: May 3, 1988

[54] MODULAR STRUCTURE FOR A PREFABRICATED BUILDING

[76] Inventor: Juan A. M. Baena, Barriada de los Millones Bloque, 5 Bajo Malaga, Spain

[21] Appl. No.: 868,638

[22] Filed: May 29, 1986

[30] Foreign Application Priority Data

Jun. 5, 1985 [ES] Spain ..... 543.952
May 22, 1986 [ES] Spain ..... 555.227

[51] Int. Cl.[4] ..... E04C 3/10

[52] U.S. Cl. ..... 52/227; 52/585; 403/407.1

[58] Field of Search ..... 52/227, 585, 408, 409.1; 403/407.1, 405.1

[56] References Cited

U.S. PATENT DOCUMENTS 1,397,976 11/1921 McAvoy ..... 52/227
3,017,657 1/1962 Mills ..... 403/409.1 X
3,537,736 11/1970 Kroopp ..... 403/409.1 X
3,884,589 5/1975 Liedholm ..... 403/405.1 X
4,012,880 3/1977 Logie ..... 52/585
4,045,927 9/1977 Diaz ..... 403/409.1 X
4,116,573 9/1978 Fuchs ..... 52/585 X
4,202,645 5/1980 Giovannetti ..... 403/407.1
4,299,067 11/1981 Bertschi ..... 403/409.1 X

*Primary Examiner*—Carl D. Friedman
*Attorney, Agent, or Firm*—Ladas & Parry

[57] ABSTRACT

A modular structure for a prefabricated building includes prefabricated modules connected by dowel type fasteners. The fasteners include a dowel element with a diverging frustum of cone sectors which form heads at each end of the dowel and set screw fasteners which have a frustum of the cone front end which bears on the frustum portion of the dowel. The dowel fits in opposing holes in the panel edges and the set screws are inserted in blind holes which lead into the dowel receiving holes.

18 Claims, 18 Drawing Sheets

82
83
84
74
82
83

82
83
N
82
74a 74
84
A
A'

72
82
82
74
76

68
84a 68
86
84-85
86
87

68
84a
B
B'

72
71
86
68

87
74a 72
74a
76

68a
89

68a 88
75a 75a
77

74a

74a
C
C'

68a

68a
D
D'

75a

75a
E
E'

A-B

MODULAR STRUCTURE FOR A PREFABRICATED BUILDING

The invention relates to improvements to a modular structure for a prefabricated building the improvements resulting in optimum assembly of such modular structures for exterior walls, partitioning and the roof, thereby achieving perfect adjustments, airtight sealing, and greater, structural stiffness, without such detriment to the modular structures as would prevent adaptability to the specific requirements of each particular case.

As is known, there exist a wide range of modular structures for prefabricated buildings. Different types of panels are known for exterior walls, namely panels made of different materials forming respective layers which render same sufficiently resistant, airtight and thermally insulating, and, likewise, a large number of roof and other panels and for the remaining types of complementary modules required to complete the building.

Prefabricated buildings of this type are generally built on a base of reinforced concrete, this being the only non-prefabricated element, i.e., it is constructed on site. The base has a step or a profile is fixed to it corresponding to the perimeter of the building and having a groove or channel for fixing the lower edge of the exterior wall panels. The upper edge of the panels are fitted complementarily with a band module or other similar element, likewise provided with a groove or channel for laterally holding the panels, the band module also being the supporting element for the roof modules.

The use of airtight joints or seals between the panels or modules, is likewise known.

However, the actual structural concept of these buildings obviously results in insufficient lateral adjustment between the modules, no means being provided for holding each module tightly against the adjacent modules, wherefore the efficiency of the joints is nominal. The use of dovetail joints is called for, though this does not afford a wholly satisfactory solution to the problem.

In an attempt to solve the above problem, there are likewise known modular panels for prefabricated buildings having a metal frame provided with bores such that each panel may be rigidly fastened to adjacent panels with threaded rods or bolts and the respective sets of nuts although providing a solution to the problem, it also provides a further problem, namely, that the modules may only be partially prefabricated, as the mentioned screws must be tightened from the inside, wherefore a complete finish may only be obtained after assembly. Dismantling the assembled building is also impossible without previously removing the finishing closure elements mentioned above. The improvements foreseen by the invention provide a wholly satisfactory solution to this problem, allowing prefabrication of completely finished panels or modules requiring no further handling after assembly, the modules being perfectly coupled to each other, not only vertically, which is aided by the actual weight of the structure, but also laterally. The modules are, therefore easy-to-handle and quick both to assemble and dismantle.

In accordance with the improvements foreseen by the invention, a structure may be based on a web of metal profiles, for levelling and alignment, arranged on a concrete plate, i.e. slab, for example, when the building is to be constructed directly on the land. However this base may be established at different heights in order to build prefabricated units at different levels.

Slab-shaped panels or modules may be made of reinforced concrete, with an inner cavity filled with a thermal insulating material, such as polystyrene or any other material with suitable properties against thermal and acoustic conduction.

In accordance with a basic characteristic of the invention, the panels are provided with a plurality of blind bores, suitably, i.e. correspondingly distributed along the edges to be coupled to other panels or modules, i.e. juxtaposed edges. The blind bores open into the edges and are perpendicular thereto. The bores also open either towards one, inner face of the panel or towards both opposite faces near their blind bottoms. The bores being designed to house specific fittings which shall be hereinafter described and which allow the coupling of two exterior wall panels, of exterior wall panels to columns, of exterior wall panels to interior partitions, of exterior wall panels to roof modules, etc.

The panels or modules, have, on their coupling edges at least one continuous, longitudinal groove, the groove or grooves of each module opposing the same in the complementary modules on coupling therebetween. The grooves are designed to house airtight joints which shall likewise be hereinafter described.

The panels or or modules, in general, all have the same outer dimensions. Some are provided with a window, others with a door, and others will be completely blind, with the obvious purpose of adapting construction to any specific project.

The fittings used between modules, which have already been mentioned hereinbefore and which allow coupling between panels and columns, between two panels and between panels and roof, consist of steel fasteners or bolts, the opposite ends whereof expand into respective heads through diverging frustrum-of-the-cone sectors. The bolts respectively fit into opposed bores of two adjacent modules, such that the heads thereof each slightly surpass the axis of openings therefrom toward one or both faces of the panels. These openings are bores perpendicular to the generally-planer face of the respective panels or modules into which they open. Setscrews are suitably placed within the latter bores to have frustrum-of-the-cone fronts, i.e. ends in the bores which abuttingly affect the frustrum-of-the-cone sectors of the heads of the coupling bolts in the other, edge-opening bores, for tight coupling between the two modules in question. In special cases, such as, for example, in the case of columns having by nuts embedded nuts for receiving threaded steel bolts, the former bolts have only one cone-expanded head at one end and a threaded sector at the other end for such engagement with the nut in the column.

In a standard assembly, a layer of concrete and a plate of reinforced concrete are layed on the land, the plate constituting the base for assembly of a specific building. Threaded end sections of bolts embedded in the concrete emerge from said base plate to engage the metal web for levelling and alignment, this being achieved by a simple nut and locknut system.

The web for levelling and alignment is made up of metal plates, which form the junctions with the nut system, "U"-shaped and "T"-shaped metal profiles, depending on whether they are to level and align exterior or interior walls, respectively, being mounted on said plates. For this, the "U" and "T"-shaped profiles are placed on the metal plates and welded thereto, thus constituting the mentioned metal web for levelling and alignment.

The opening of the "U" and the stem of the "T" of the profiles generally point upwards, although i.e. away from the base and metal plates, they may adopt different arrangements in order to meet the specific requirements of the building to be built.

As mentioned hereinbefore, the panels are provided with at least one continuous groove along the edges thereof. The first purpose of said grooves is to hold up or support each panel along, for example, a profile of the metal web, in such a way that the free ends of the arms of the "U"-shaped profile are housed in two grooves of the lower edge on the panel, or the end of the single stem or arm of a "T"-shaped profile is housed in a single groove on the lower edge of the panel. In both cases, one or two neoprene joints are established therebetween to ensure airtightness and a correct coupling between the panel and profile, and also to absorb any movement caused by expansions or other reasons.

Thus, the web of "U"- and "T"-shaped profiles constitutes the support for all the panels and columns making up the walls of the building.

It must be pointed out that the columns must obviously be joined to the walls by special coupling means, as mentioned hereinbefore, and lateral coupling means are therefore established between each pair of adjacent panels and the intermediate column at the corners of the building, between three panels and a column in the case of an intermediate junction when a certain interior or exterior wall is to be built, between four panels and a column, etc. Although as mentioned hereinbefore, two crossed bores are made in the coupling edge of each module or panel, one included in the actual plane of the panel and opening towards the corresponding edge, and the other being perpendicular to said panel and penetrating from the exterior surface to the inner surface, which latter bore may not reach one of the surfaces of the module, in which case there will be only one threaded bush and one setscrew as elements of attack for the corresponding head of the steel bolt which makes up the bridge joint between modules, thus constituting a likewise efficient solution and avoiding the need for bores which open towards one of the surfaces of the panels, such as, for example, towards the external surface thereof, and the need to subsequently close such openings.

In all cases, the grooves provided on the edges of the modules are comprised by channels which likewise house neoprene joints similar to those mentioned previously for its lower edge, and thus, as the pressure established between the modules may be adjusted by means of the previously mentioned steel boltes and setscrews, airtightness between the coupled elements is ensured, the section of the joint, initially circular, being transformed towards a square configuration.

In order to facilitate the absence of thermal bridges, auciliary grooves are further provided on the edges of the modules, likewise to define closed cavities which are filled with insulating material introduced under pressure once the modules have been coupled.

These auxiliary groove filled with insulating material are housed at the junctions of the parts or modules which make up the building.

In order to join the wall modules to each other, or to the respective columns, the relevant parts are placed such that their edges are opposed, having previously effected the following operations:

Housing the coupling steel bolts or rods in the duly opposed longitudinal bores;

Placing the neoprene joints in the grooves of every two adjacent panels;

Tightening the screws of the coupling bushes;

Filling the cavities constituted by the grooves which are opposed on coupling the various components with insulating material.

On tightening the screws, and due to the conical shape of their operative end, the modules are displaced slightly towards each other when said screws abut against the frustrum-of-the-cone sectors which connect the bolts to the end heads thereof, thereby tightly holding the neopren joints contained between their edges, and ensuring airtightness on coupling.

With respect to the coupling between panels and columns, it should be pointed out that the latter must include special elements, which have already been mentioned hereinbefore, and which are similar to those used for fastening between panels, except that in this case the bolts have a threaded end for engaging the nut embedded within the column, which nut is duly fastened to the corresponding nut or nuts for receiving another panel or panels by means of bolts or rods having threaded ends and which, depending on whether they are to join a column to two coplanar walls, a column to two perpendicular walls, a column to three walls or a column to four walls, may be straight, "L"-shaped, "T"-shaped or cross-shaped, respectively.

As has likewise been mentioned hereinbefore, said coupling or fastening elements are embedded within the columns and engage the respective nuts through the threaded ends thereof, said nuts being likewise embedded within the column and being designed to engage the steel bolts or rods for coupling between panels, which shall in this case have only one frustrum-of-the-cone head, being at the end corresponding to the panel, and a threaded sector at the end corresponding to the column, in order to complement said nut, thus achieving a tight coupling of each panel to the column in a manner identical to that between panels and thereby favouring the approximation of the latter against the column and holding the neoprene joint established therebetween tightly, to further ensure airtight sealing.

In the above case of coupling between wall panels and columns, the channels formed by the grooves provided in both the wall panels and the column are likewis filled with insulating material which is injected after assembly of the respective elements.

On the other hand, the roof panels must obviously be joined to the parapet, i.e., to all the exterior walls. In this respect, after assembly of all the panels of one floor, the upper edges of said panels are at one same level and are coupled to the mentioned roof panels with the aid of fastening elements identical to those used for coupling of wall panels or modules.

Such roof panels or slabs have an "H"-shaped cross section, the middle sector having a bevel or stepping. They are provided with side arms or flanges which project both up and down on both sides of the middle sector and which have longitudinal channels or grooves both externally and laterally for housing neoprene joints, as in the previous cases, to ensure airtightness of one panel against the adjacent one by means of a suitable pressure regulated by through-screws with the purpose of ensuring stiffness, as a single block, of the panels which make up the roof.

Airtightness at the top of the ridge, formed at the junction of every two slopes of the roof is reinforced with the aid of an inverted U-shaped metal element.

On the lower part of each roof panel, and on the area which is to rest on the exterior wall, there is provided an overhang which ensures perpendicular support on said wall, at the junction.

Similarly elevations are established on the upper part of each roof panel, at the ridge area, and are opposed on either side of the vertex of said ridge, to be subsequently fastened by adequate through-screws. The cover of said ridge is made of a metal plate of a special design.

The roof panels support suspended agglomerate roofs on their lower edge, which roofs are fastened to the edges of the plates by means of metal profiles, an insulating layer of glassfibre or any other suitable material being further layed over such roofs.

In accordance with a further optional characteristic of the invention, the addition to the structure of a new type of module has been foreseen, with the purpose of providing an insertable band between the upper edge of the exterior wall panels and the lower heel, partition or projection of the roof panels, said band module further including, in addition to the grooves common to other modules of the structure provided on the upper and lower edges for housing the respective airtight joints. a straight stepping on its internal surface which defines a perimetral flange for supporting the structural modules of the finishing or closing plane.

More specifically, these finishing modules have a flattened body of limited thickness, and a continuous internal surface, with a variable modular width and length, in order that they may be adapted to the specific needs of each particular case, the upper side whereof includes a perimetral partition and a plurality of short, intermediate transversal partitions which stiffen the structure of the module in question and allow lateral coupling between modules with the aid of through-screws and respective nuts, as in the lateral coupling between roof modules.

In accordance with a further characteristic of the invention, and more specifically when the cited band modules are used, the roof panels adopt the same shape as the finishing modules, i.e., they have a flat, continuous surface, as opposed to the stepped profile of the roof panels of the previous case, the only difference with respect to the finishing panels being the necessary provision on the lower surface of the heel, through which said roof panels rest on the band modules which, in turn, rest on the upper edge of the exterior wall panels.

For fastening the above elements, the lower edge of the heel of the roof panels or slabs is provided with a grooved profile, preferably triangular in.shape and having a narrowed opening, embedded therein in which are established, with the possibility of longitudinal displacement, the nuts or respective fastening screws which cross the band modules at points suitably distributed therealong, preferably at the end areas, which screws have an expanded head at their lower end, through a frustrum-of-the-cone sector, as in the bolts used for coupling exterior wall modules, such that the length of said screws allows the expanded heads thereof to lie at the same level as the repeatedly mentioned setscrews provided in the exterior wall modules for coupling and subsequent tightening thereof on acting upon the mentioned bolt or screw, through the frustrum-of-the-cone sector close to the head thereof. Thus, coupling of the roof modules to the exterior wall modules is achieved by means of said screws, with the insertion therebetween of the band modules.

It would likewise be pointed out, as a further characteristic of the invention, that the band modules may be either straight or bent at 90°, depending on whether they are located in the middle of a wall of the building or at a corner thereof, and that they are furthermore provided with slight elevation on the upper side defining an elevated external area, perfectly adapted to the heel of the roof modules, the edge of such elevation having a slight channel which acts as a collector for possible dampness and drains towards the lower area of the band module, outside the exterior walls of the building, through communicating holes made between said channel on the upper side of the band module and the lower external area thereof, said holes being suitably distributed along the band.

The band modules may also be coupled to each other through their adjacent ends, in the same way as for lateral coupling between panels, although such coupling is not necessary, for the simple reason that, as the band modules are joined to the exterior wall panels and these latter are joined to each other, the former are likewise, though indirectly, stiffened.

In order to complete the description being made, and to assist the better understanding of the characteristics of the invention, a set of drawings is attached to the present Specification, as an integral part thereof, wherein the following has been shown in an illustrative and non-limiting manner:

Figure 18:
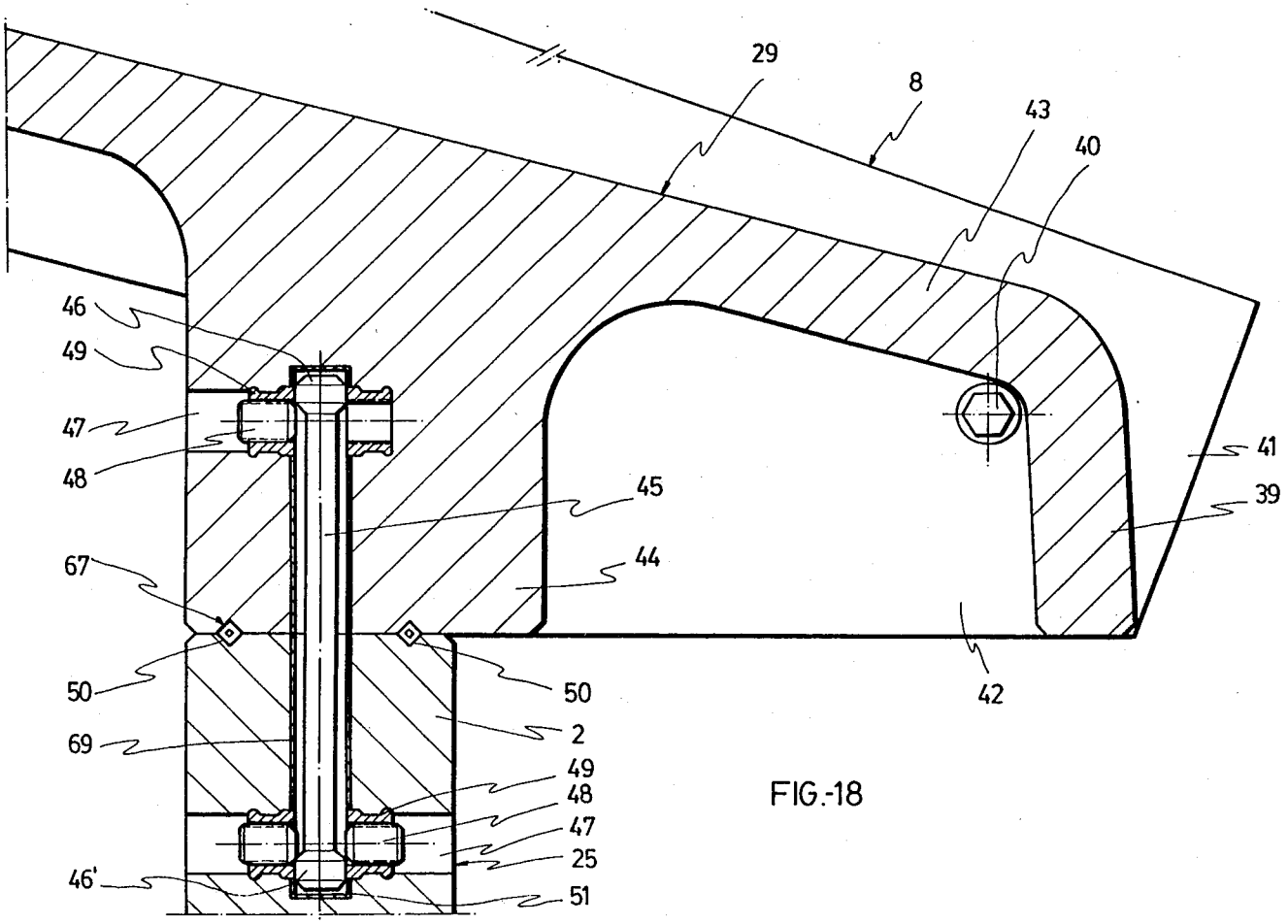

FIG. 18 an enlarged detail, accurately showing the means for assembly of a roof panel to an exterior wall panel.

Figure 19:
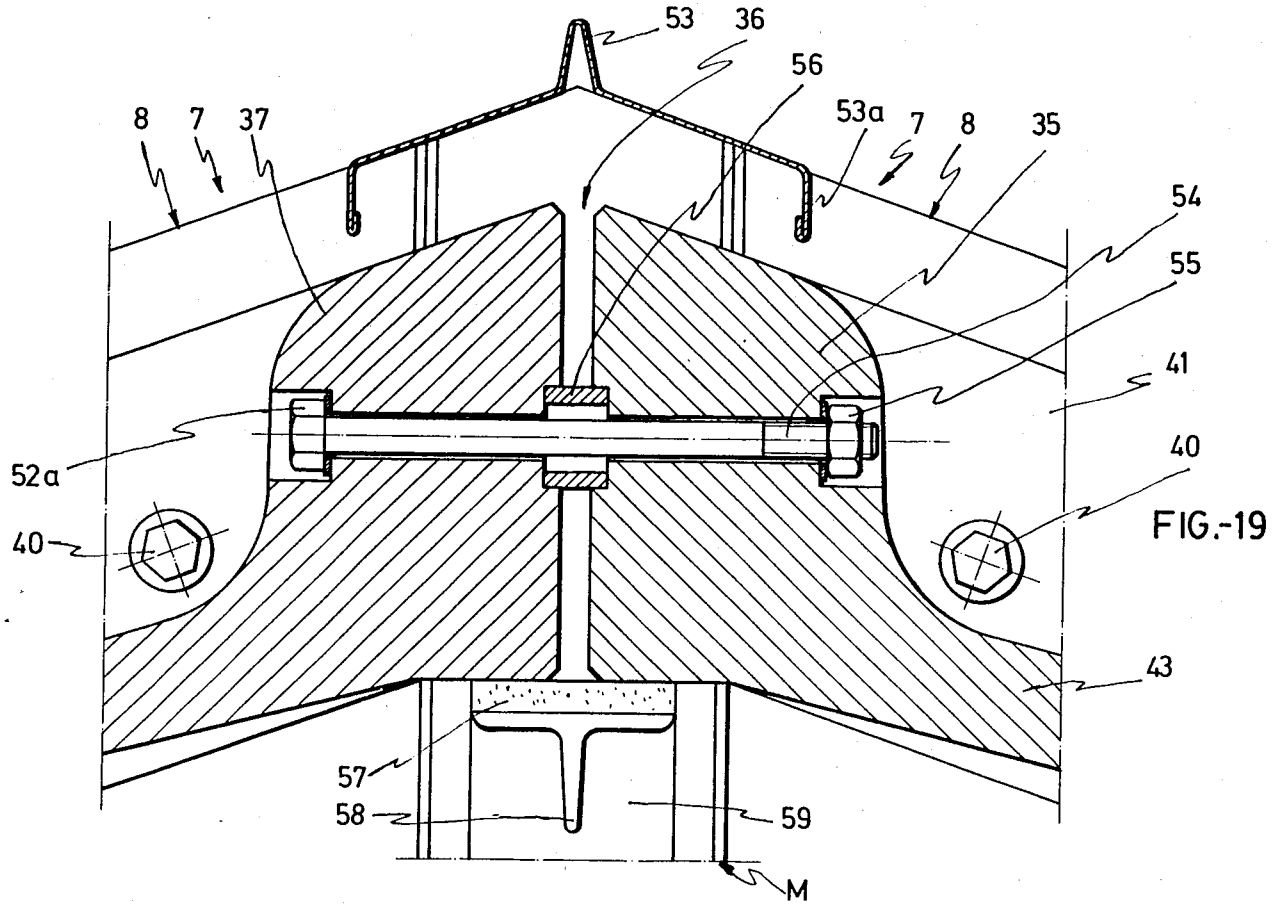

FIG. 19 shows an enlarged detail of the coupling between two roof panels at the ridge area.

Figure 20:
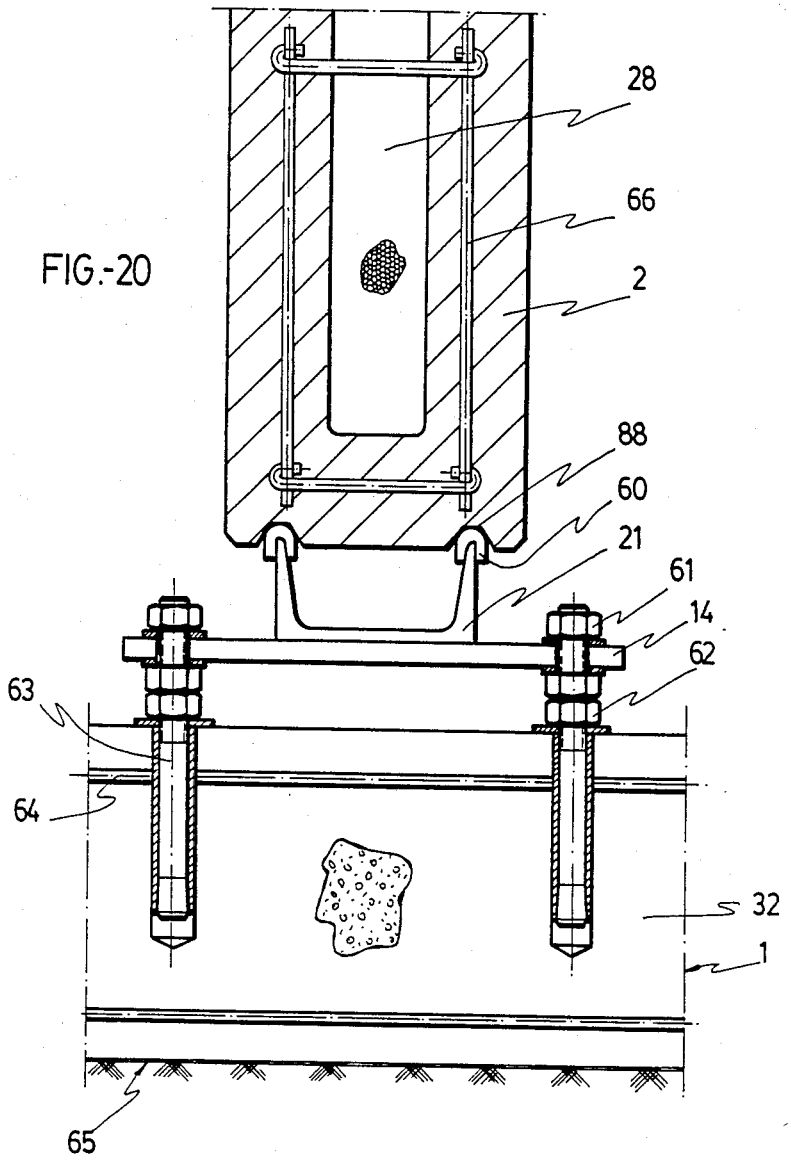

FIG. 20 shows a cross sectional detail of the seating of a wall panel on the base plate.

Figure 21:
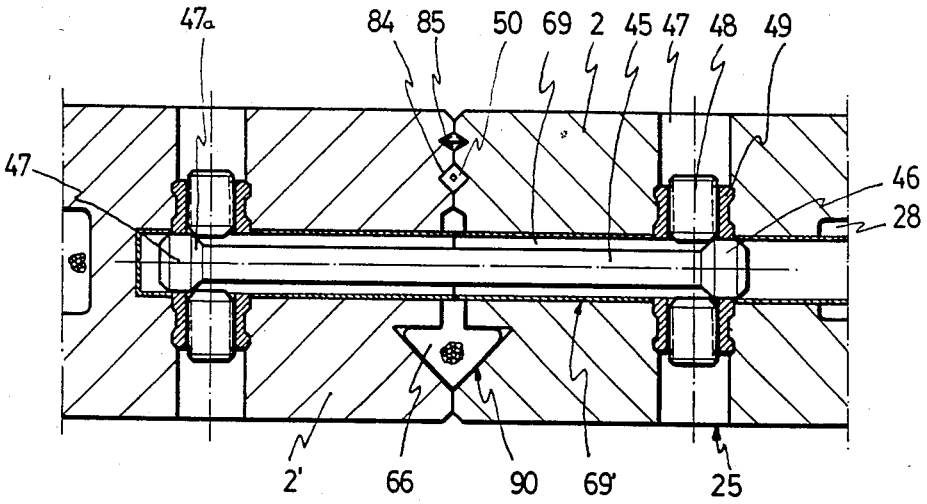

FIG. 21 shows a likewise partial sectional detail of the coupling between two panels, and, more specifically, between two exterior wall panels of the building.

Figure 22:
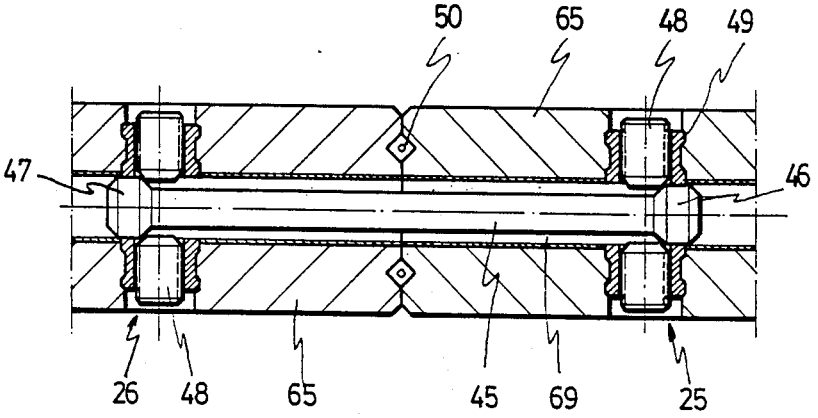

FIG. 22 shows the same coupling as in the preceding figure, corresponding, in this case, to two interior partitioning panels.

Figure 23:
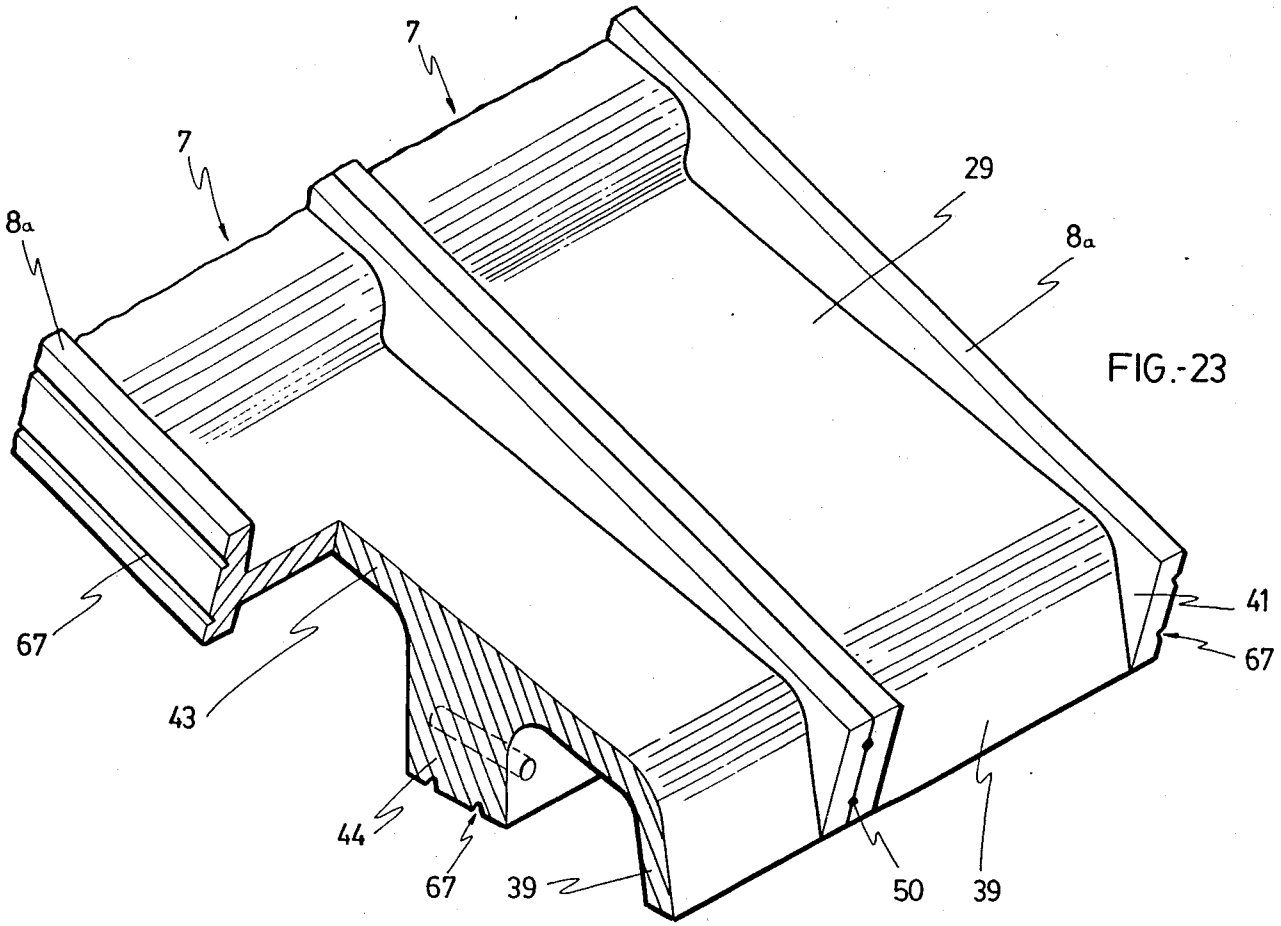

FIG. 23 shows a partial perspective detail of two adjacent roof panels, one being partially sectioned showing the structure thereof.

Figure 24:
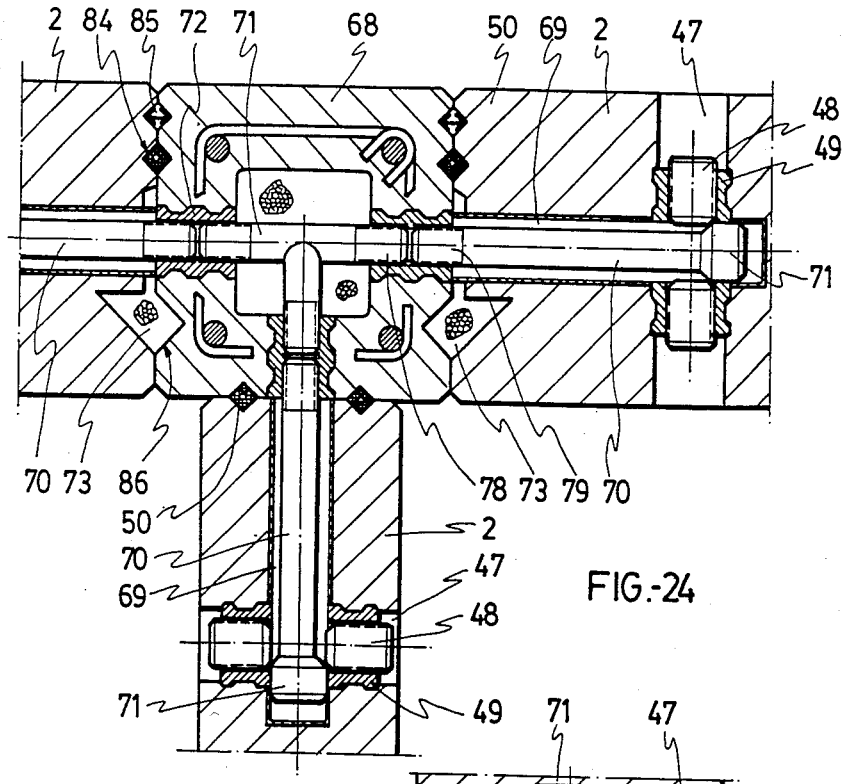

FIG. 24 shows a cross sectional detail of the junction and coupling of a column and three wall panels.

Figure 25:
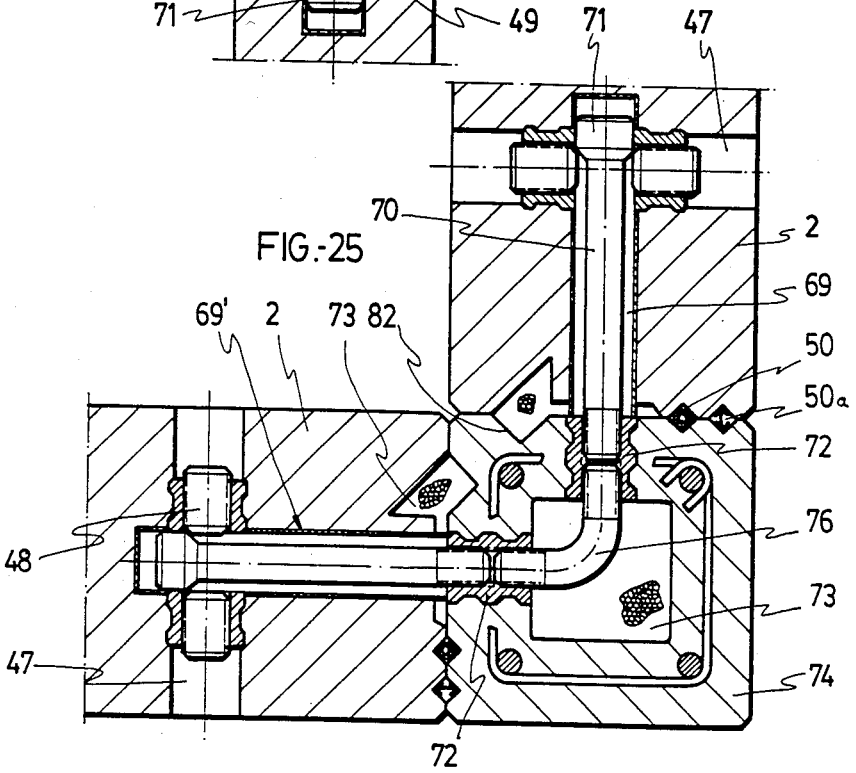

FIG. 25 is a similar detail to the above, showing, in this case, the coupling, at an angle, of a column and two wall panels.

Figure 26:
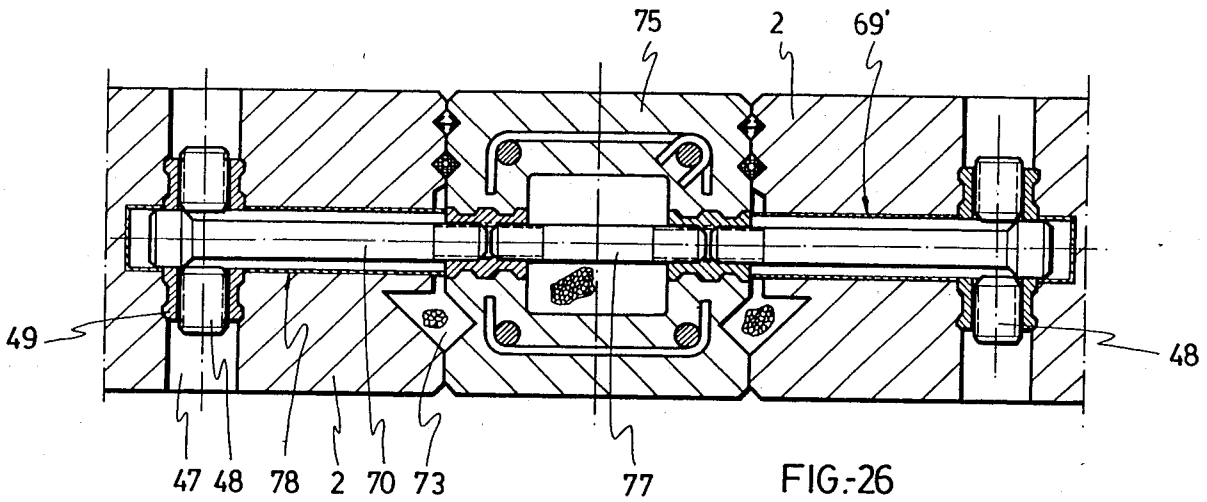

FIG. 26 is a similar detail to that of the preceding figure, showing, in this case, the coupling of a column and two coplanar wall panels.

Figure 27:
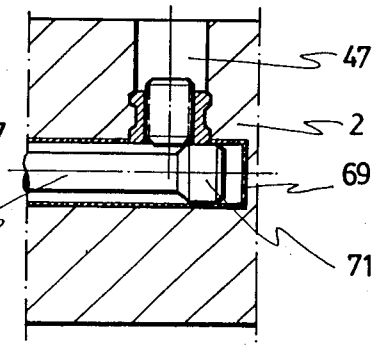
Figure 28:
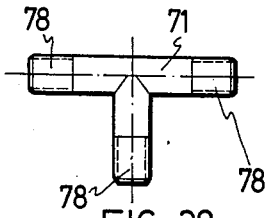
Figure 29:
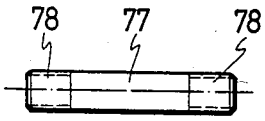
Figure 30:
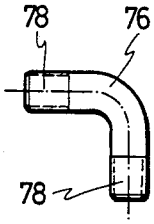
Figure 31:
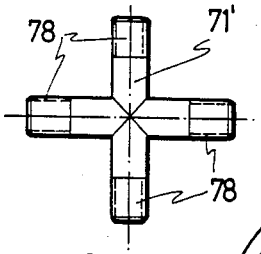

FIG. 27 shows an end detail of a wall panel or module wherein the transversal bore which receives the fastening means of said panel to a second panel or to column is blind to the exterior.

FIGS. 28, 29, 30 and 31 show details of the different elements to be housed within the columns for the coupling thereto of four, three and two wall modules, respectively; in the case of two wall modules, these may be either or perpendicular.

Figure 32:
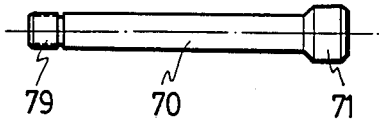

FIG. 32 shows the steel bolt or rod used together with the elements shown in the four preceding figures, for coupling respective wall panels to the column in question.

Figure 33:
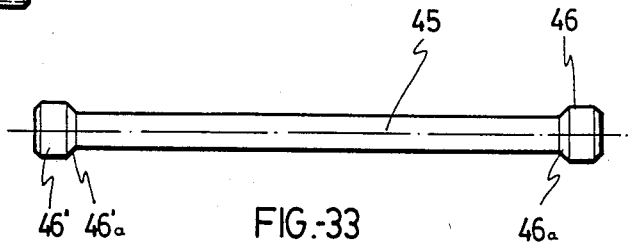

FIG. 33 shows a steel bolt or rod, similar to that of the preceding figure, but having, in this case, two end heads for the coupling of one panel to another, in accordance with FIGS. 18, 21 and 22.

Figure 34:
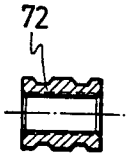

FIG. 34 shows a diametrical section of one of the nuts to be embedded within the columns, and specifically engaging the threaded ends of the elements shown in FIGS. 28 to 31.

Figure 36:
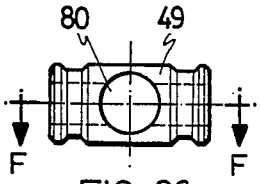
Figure 35:
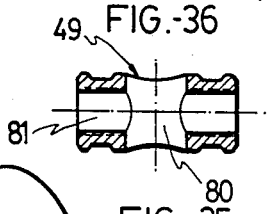

FIGS. 35 and 36 show a diametrical section and elevation view, respectively, of one of the nuts housed within the bores of the panels, perpendicular thereto, which cross the bores designed to receive the bolts shown in FIGS. 32 and 33.

Figure 37:
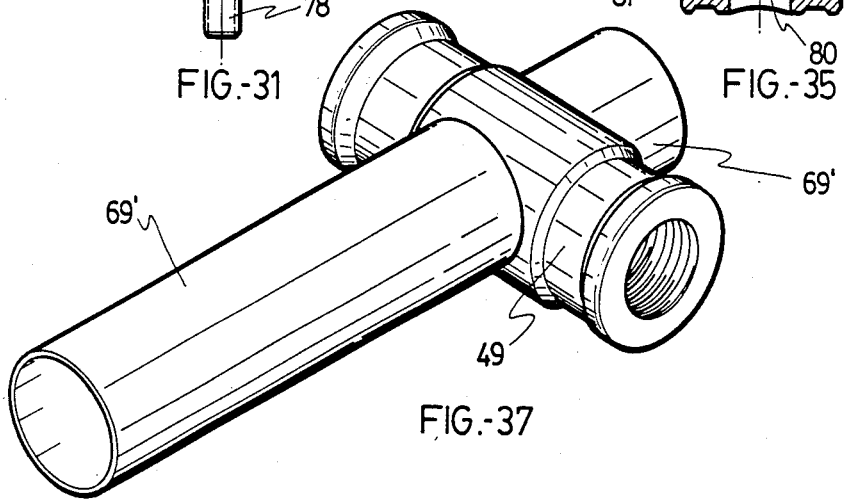

FIG. 37 shows a perspective view of the nut shown in FIGS. 35 and 36, with a continuous line when said nut is single and discontinuous when same is double, constituting a single-piece assembly with a metal bushing designed to define the bore which houses the bolt shown in FIGS. 32 and 33, said assembly being likewise embedded within the panel or module comprising the actual structure of this latter.

Figures 38, 39, 40, 41, 42, 43, 44, 45, 46:
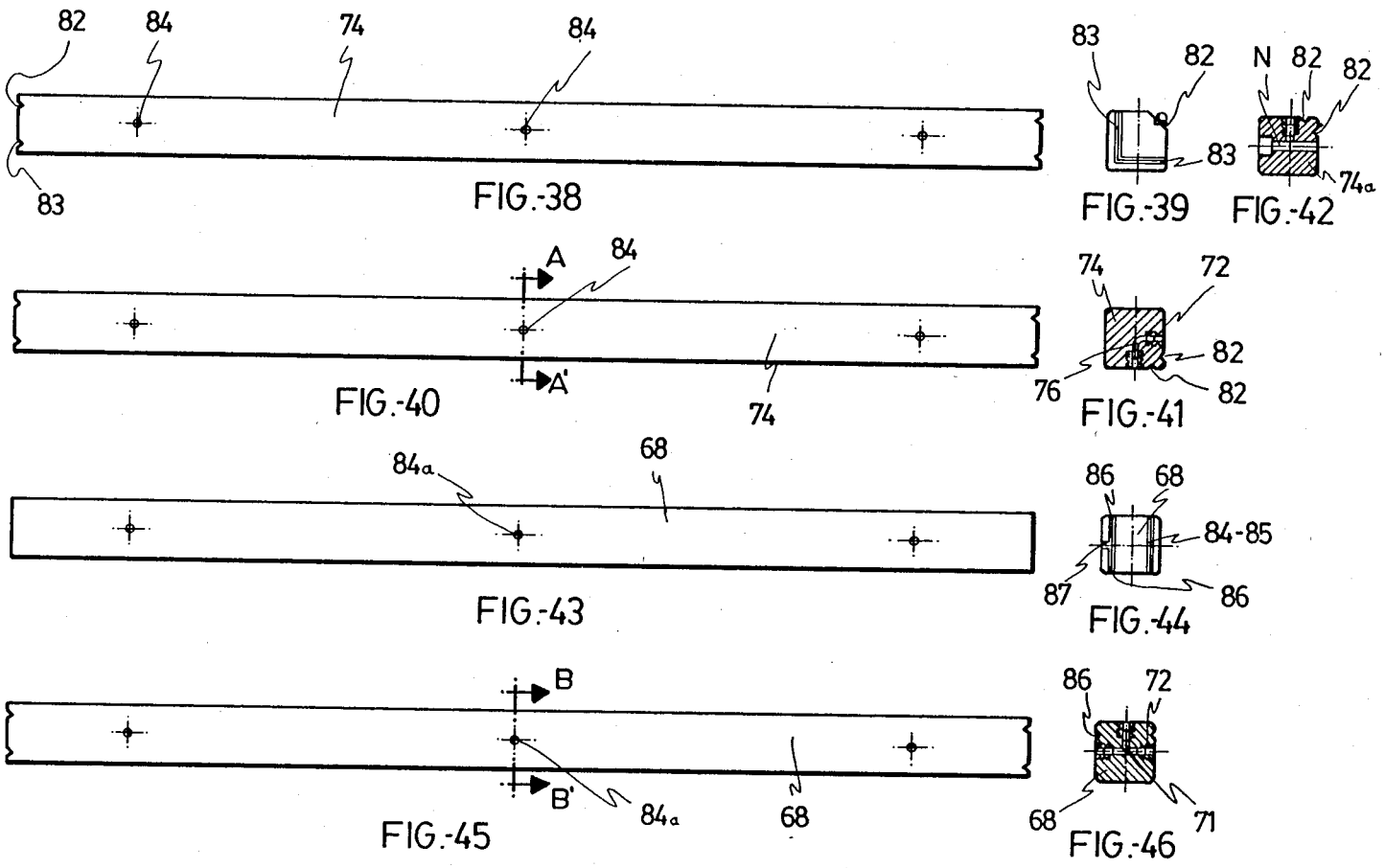
Figures 47, 48, 49, 50, 51, 52, 53, 54, 55, 56, 57, 58:
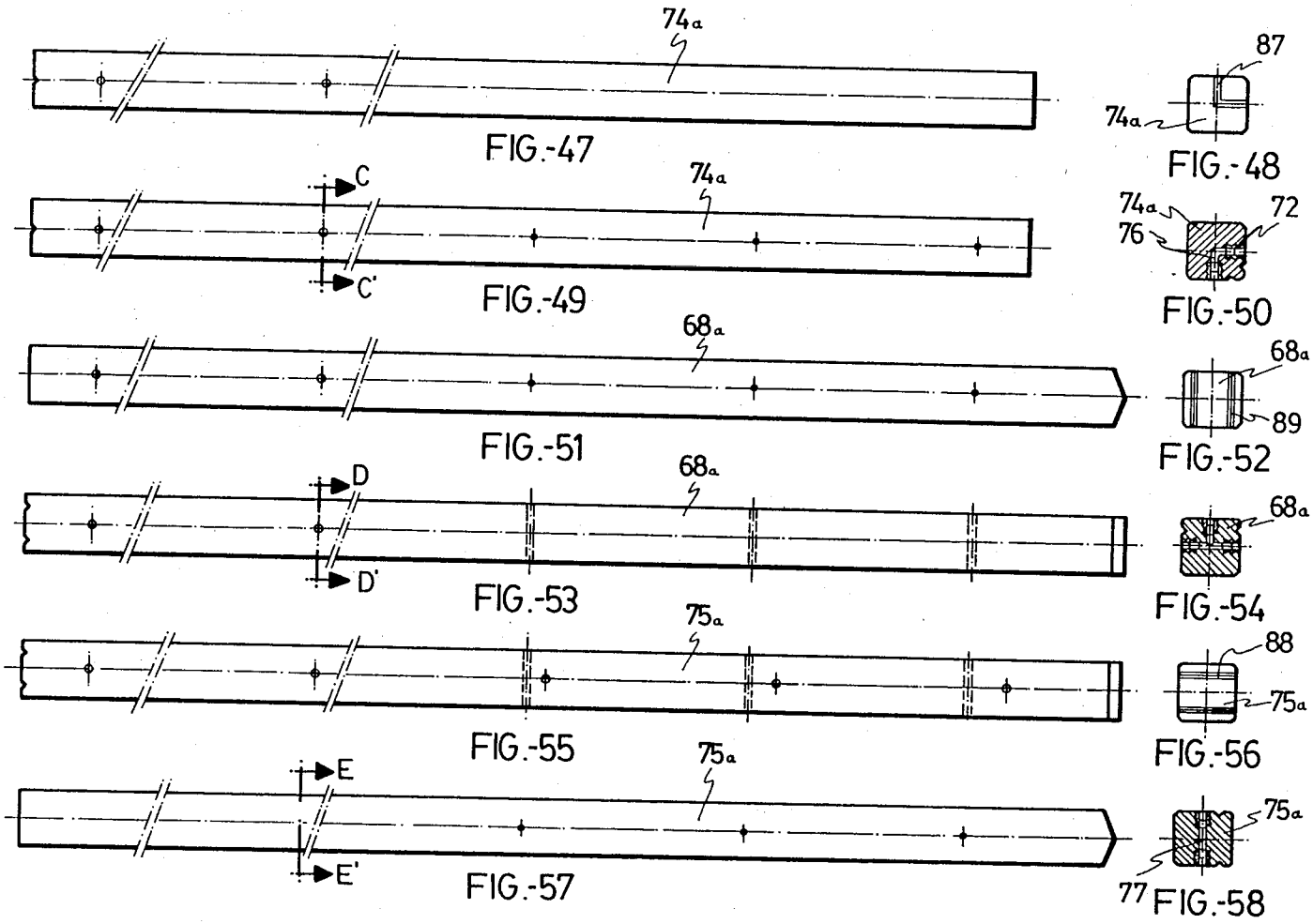

FIGS. 38 show 39 an elevation and profile view, respectively, of a corner column.

FIG. 40 and 41 show the same column as in figure 38, in an elevation view 90° out-of-phase with respect thereto, and in a transversal section along line A-A' of FIG. 40.

FIG. 42 is a similar section to that of FIG. 41, along the same line A-A', showing a special conception for coupling of the wall panels to the column, and specifically to the column being the initial or end column of the building.

FIGS. 43, 44, 45 and 46 6 show, respectively, an view of a column for joining three wall panels, a profile of said column, a further side elevation view 90° out-of-phase with respect to that of FIG. 43, and a cross section along line B-B' of FIG. 45.

FIGS. 47 to 58 show side elevation views, with corresponding profiles or sections, relative to other columns used in a building made in accordance with the improvement the invention.

Figure 59:
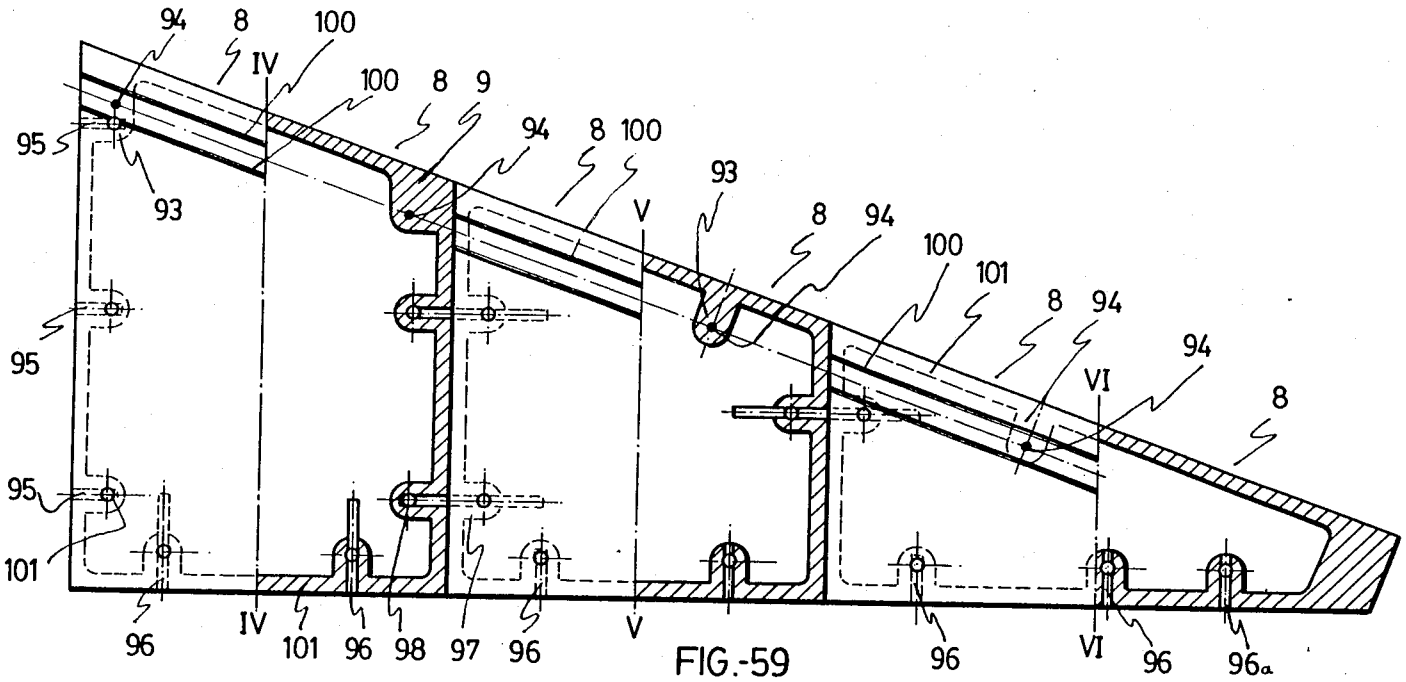
Figure 60:
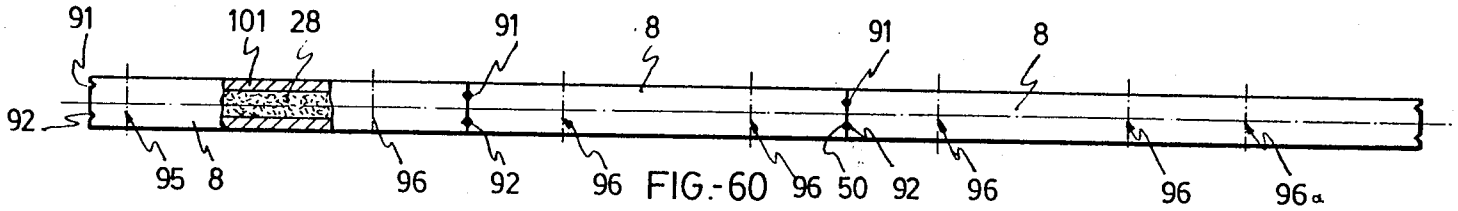

FIGS. 59 and 60 a partially section side elevation and plan view of the gable ends which complete the structure of the building.

Figure 61:
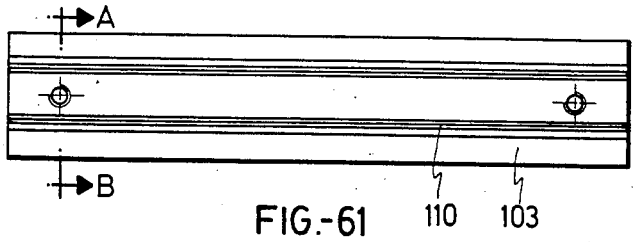

FIG. 61 shows a plan view of the band module on which is centred one of the improvements object of the present invention.

Figure 62:
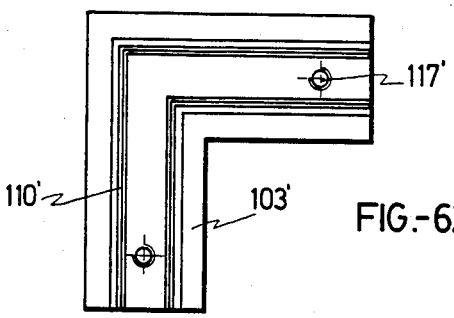

FIG. 62 likewise shows a plan view of a band module, corresponding in this case, to a corner of the building.

Figure 63:
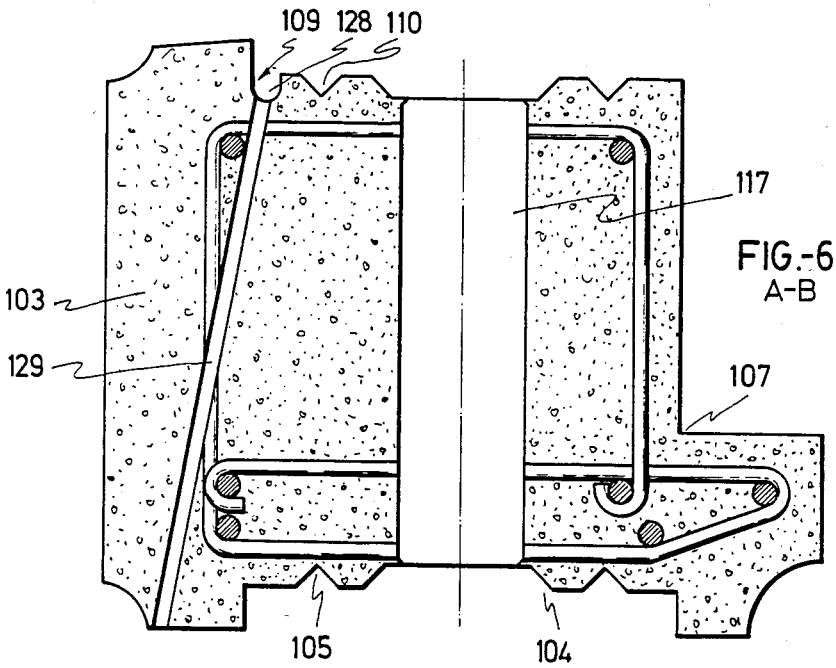

FIG. 63 a transversal section of any one of the modules shown in the preceding figures, taken along line A-B thereof.

Figure 64:
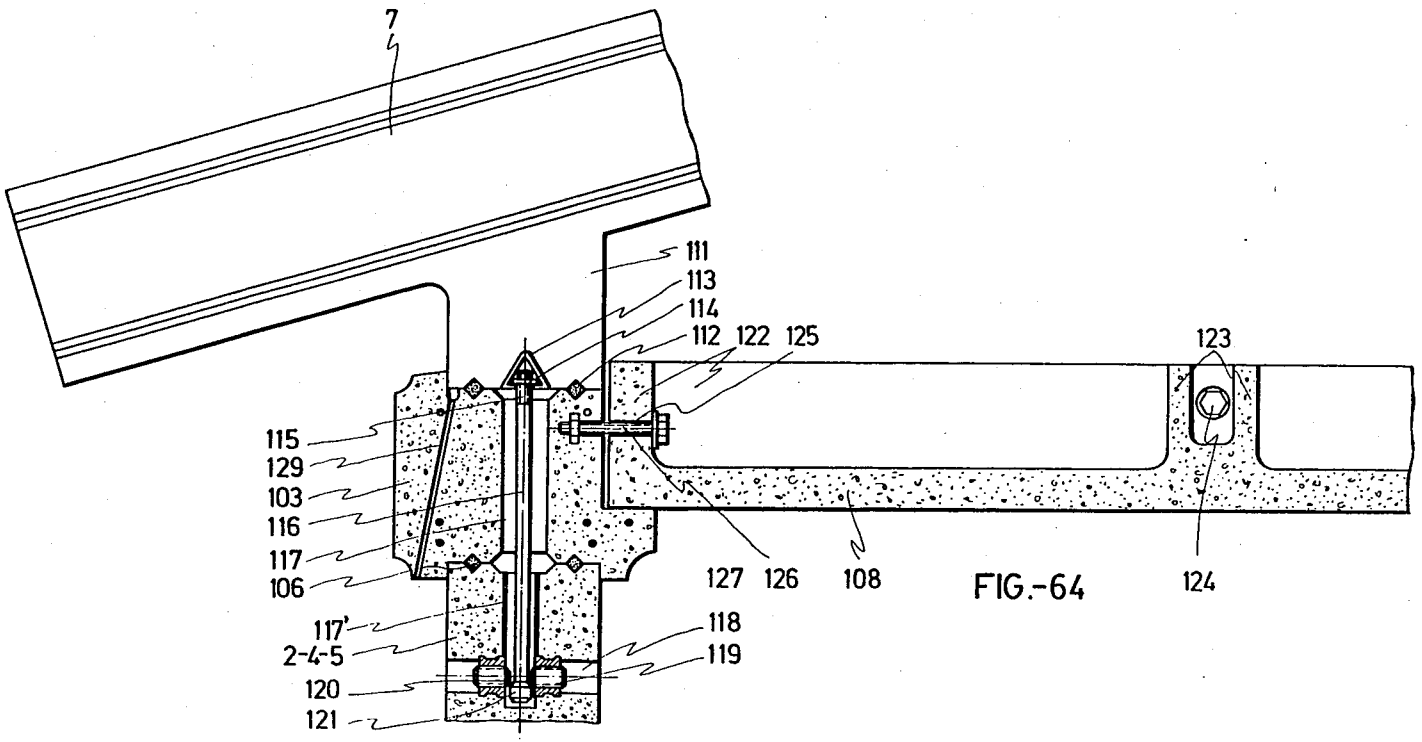

FIG. 64 shows a partial side elevation and sectional detail of a building, at the junction of roof, finishing element and walls by means of the band module shown in the previous figures.

Figure 1:
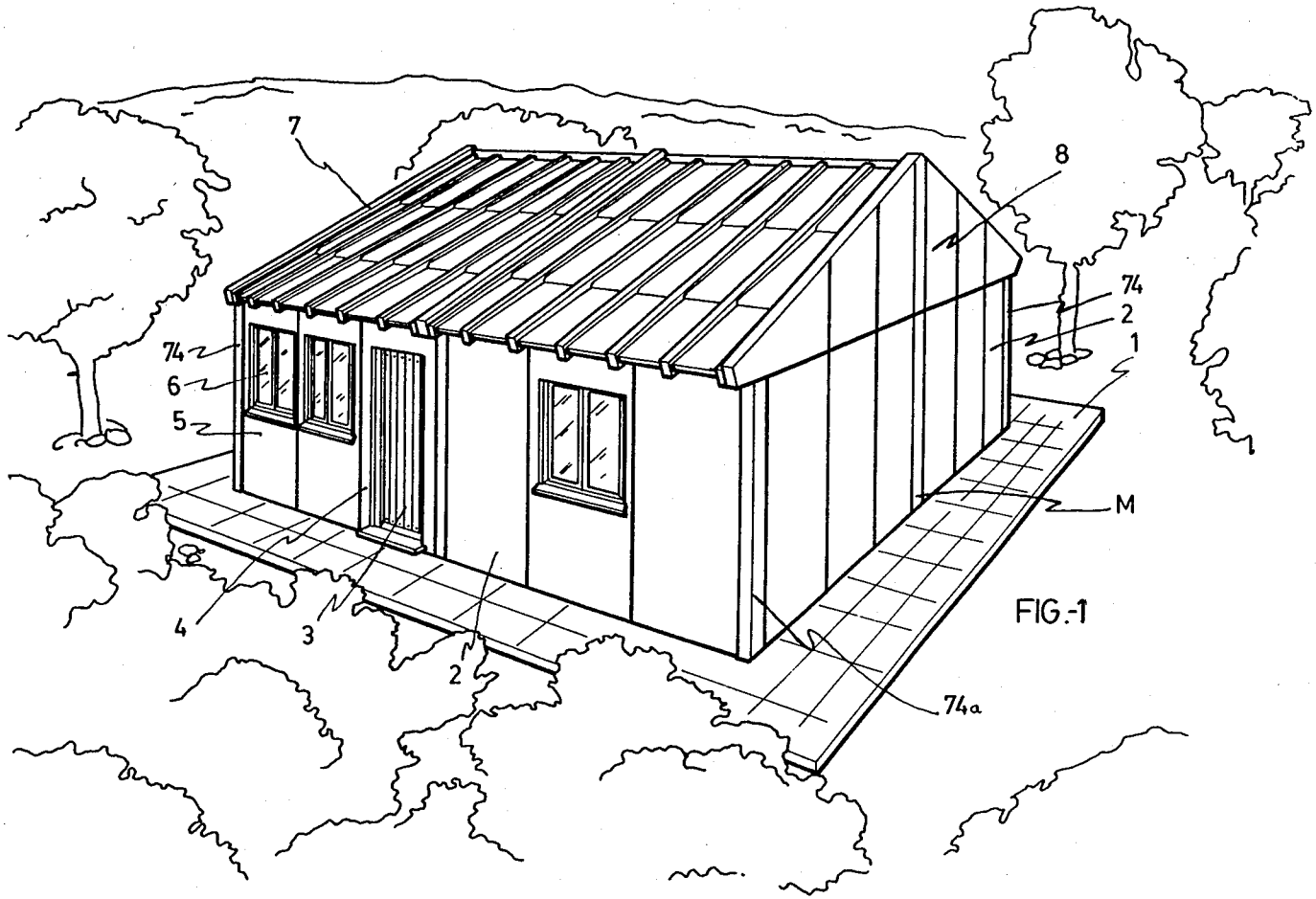
FIG. 1 shows a general perspective view of a prefabricated building based on a modular structure in accordance with the improvements comprising the object of the present invention.

In the light of these figures, and more specifically of FIG. 1, it can be seen how in a modular building in accordance with the present invention, a series of wall panels or modules 2, a door panel 4 provided with door 3 and a window panel 5 likewise provided with the corresponding window 6, are arranged on a base 1, which wall panels are complemented with modules 8 constituting the gable ends, the assembly being closed by a roof made up of panels 7.

Figure 16:
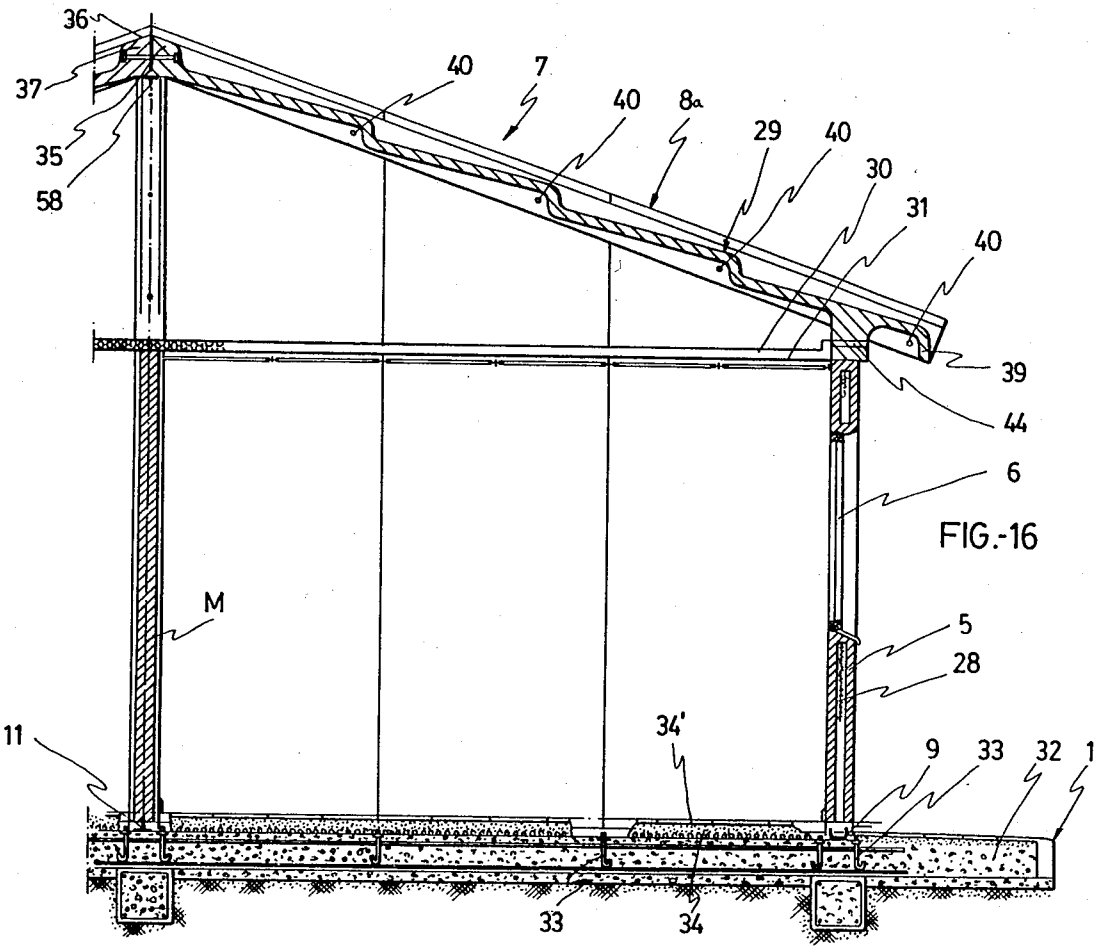
FIG. 16 is a transverse section of the building, showing the section of a roof panel, a window panel, a false or suspended roof, an interior partition, the levelling and alignment web and the concrete base.
Figure 17:
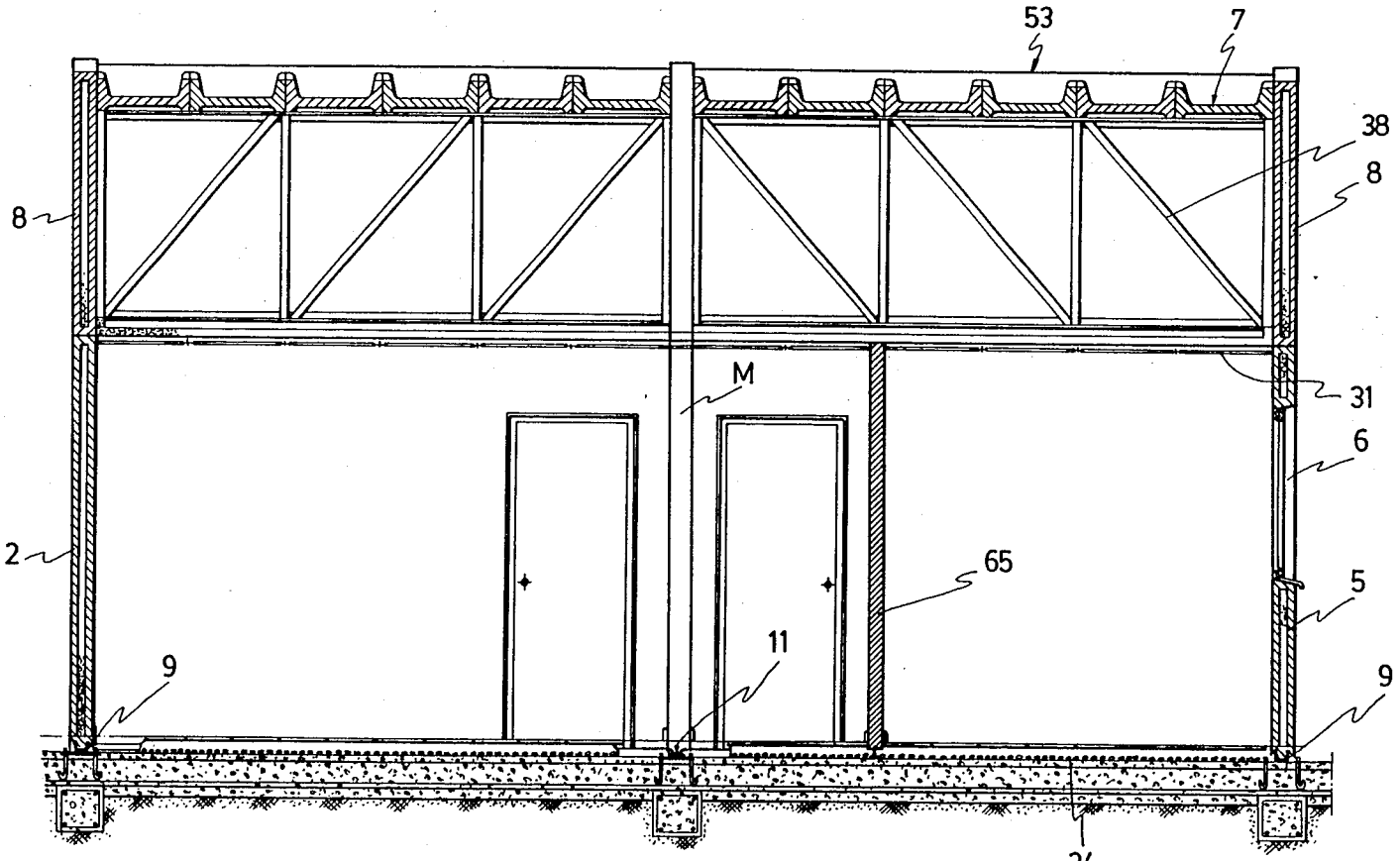
FIG. 17 is a longitudinal section of the same building, showing the metal joists which support the roof panels at the ridge area. and the columns which hold up said joists, at the middle area of the assembly, in addition to the previous elements.

This modular building can be seen in greater detail in FIGS. 16 and 17, which show how the base 1 of the modular assembly is made by a covering layer of concrete, not marked, and a plate of reinforced concrete 32 wherefrom emerge elements 33, partially embedded in the concrete mass. This base plate is duly finished both internally and externally by means of covers 34 and 34' which are made after completion of the framework, in a manner which is not the object of the present invention, it being possible to use any known technique therefor.

Plates such as those marked 14 in FIG. 20, levelled and fitted into place with the aid of nuts and locknuts 61 and 62, are joined by known methods to the upwardly projecting elements 33, either to those shown in FIGS. 16 and 17 or to those marked 63 in FIG. 20, this difference in no way implying a modification of the invention.

The projections 33–63 are arranged over the whole of base plate 1 at predetermined positions, depending on the type of modular construction to be built, in order that the different plates, such as the previously mentioned plate 14, may rest thereon, said plates acting as the base on which the whole building is arranged.

The mentioned plates, shown in detail in FIGS. 4 to 12, may be of the type marked 14, having holes 15 for coupling and fastening to the projections 63 of base 1, and holes 15*a* and 15*b* for fastening, on the upper side, to the profiles on which rest the various panels.

The upper surface of plate 14 is provided with an elevation 16, comprised by a U-shaped profile with arms pointing upwards, and a further side elevation 17, comprised by a T-shaped profile with the stem pointing upwards. A different plate which may be used is that marked 14*a* and shown in FIGS. 7 and 8, wherein the holes 15 and 15*b* likewise serve to fasten the plate to elements 63 of base 1 and to the longitudinal profiles. In this case, elevation 18 has an L-shaped plan view and an inverted T-shaped cross section.

Figure 9:
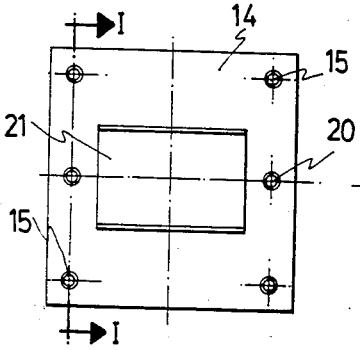
Figure 10:
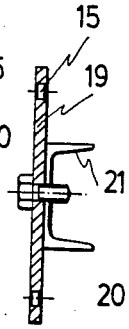
Figure 11:
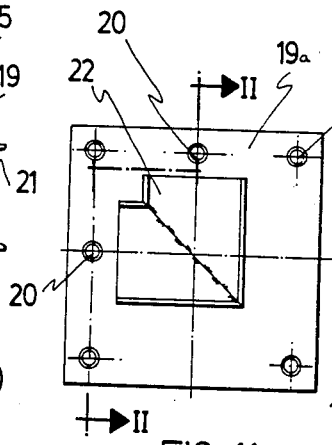
Figure 12:
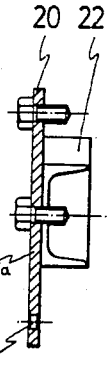

In like manner, plate 19 of FIGS. 9 and 10 has holes 15 and holes 20 and the elevation 21 adopts an inverted U shape. Plate 19*a* of FIGS. 11 and 12 is likewise provided with holes 15 and 20, and an angular elevation 22 having a U-shaped cross section.

Figure 2:
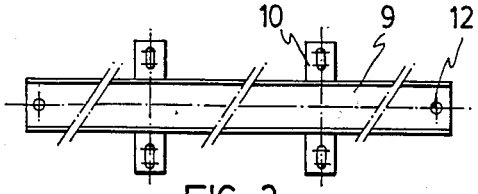
FIGS. 2 and 3 show respective plan views of the profiles which make up part of the web for levelling and alignment.
Figure 3:
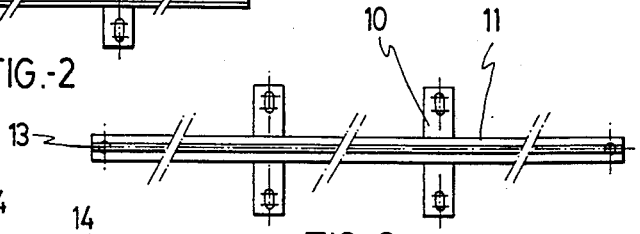
Figure 4:
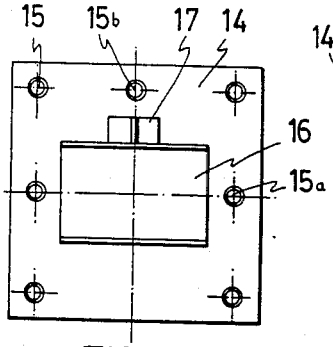
FIGS. 4 to 12 show plan, elevation and cross-sectional views of the plates which serve to support the longitudinal profiles shown in the two preceding figures and which act as junctions for the levelling and alignment web.
Figure 6:
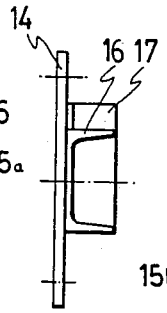
Figure 7:
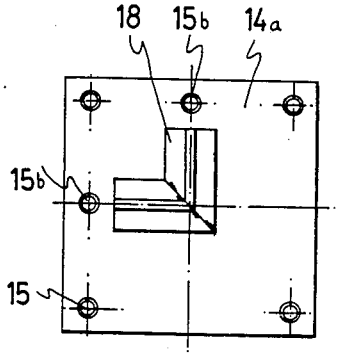
Figure 8:
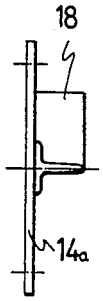
Figure 5:
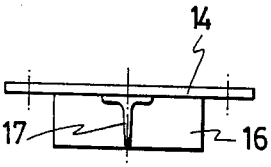

All the mentioned plates 14, 14*a*, 19 and 19*a*, are used to place the prefabricated columns thereon, either directly of through longitudinal profiles, such as those shown in FIGS. 2 and 3, which act as seating or support for the various panels 2, 4 and 5, both interior and exterior, and other interior columns such as those marked M in FIG. 16.

The profiles which make up the web on the plates are shown in FIGS. 2 and 3, marked 9 and 11, as mentioned previously, profile 9 having a U-shaped section and profile 11 having a T-shaped section, the branches of the former and the stem of the latter pointing upwards. In both cases, the base of U 9 and the arms of T 11 are placed in the lower position, the profile thereby constituting a base which will rest on plates 14, 14*a*, 19 and 19*a*, depending on the conditions of the junction.

Plates 9 and 11 are provided with end holes 12 and 13, together with intermediate support elements having slit bores, not marked, through which said profiles are fastened to the different plates 14, 14*a*, 19 19*a*, the plates and profiles making up a perfectly level web on which are arranged all the interior and exterior columns and wall panels or modules of the building.

It should be pointed out that plates 14, 14*a*, 19 and 19*a* as shown cover all possible solutions for support of columns and panels, and they may therefore be suitably combined to meet all possible solutions. Thus, plate 14 may hold a column on its elevation 16, a panel on elevation 17 and profiles 9 at the ends of 16, which would be fastened at 15*a*. Plate 14*a*, for example, may receive two profiles 11. fastened to 15*b*, and a centre column. Plate 19 may receive either a continuous profile 9 or 11 or profiles 9 and 11 at each end thereof, and a column in the middle. Plate 19*a* may receive a central column and respective side profiles.

Once the profiles and plates have been arranged in accordance with the building to be constructed, the columns and panels or modules are placed on the resulting web of profiles and plates.

Figure 13B:
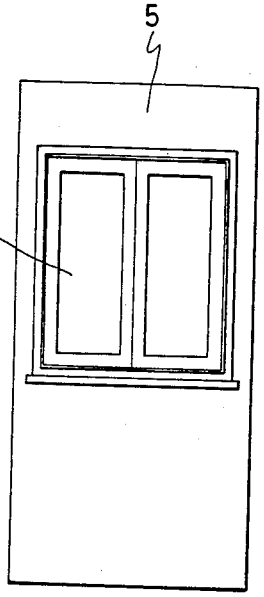
FIGS. 13 to 15 show respective modules corresponding to the exterior walls of the building, and, more specifically, a window panel, a door panel and a blind panel, respectively, in front, side and cross-sectional views.
Figure 13C:
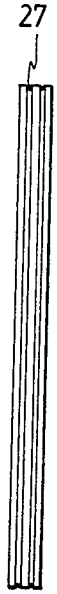
Figure 14B:
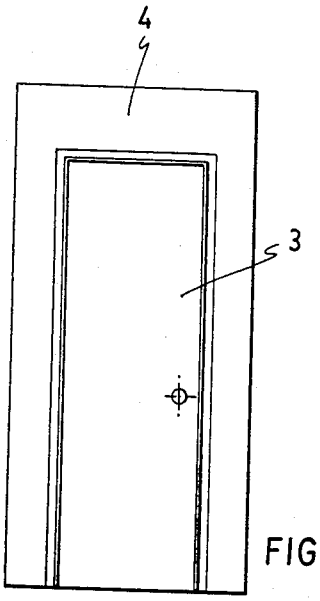
Figure 13A:
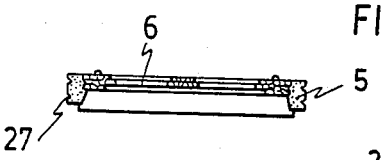
Figure 14A:
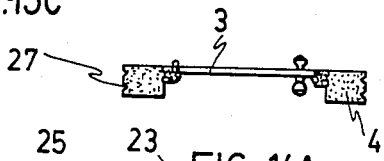
Figure 15B:
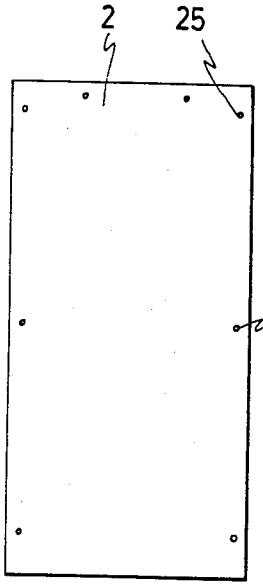
Figure 15C:
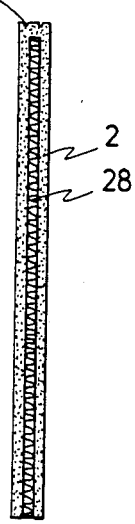
Figure 15A:
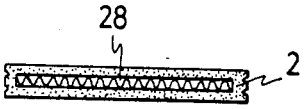

The interior and/or exterior wall panels are shown in FIGS. 13, 14 and 15. Said panels are made of a mixture of reinforced and prefabricated concrete, with an inner cavity duly filled with a suitable insulating material. Such is the case of wall panels 2, door panel 4 and window panel 5. All of said panels have at least one longitudinal groove 27 along their edges, for housing neoprene joints placed between each panel and its adjacent elements in order to achieve a suitable coupling and, more important, to obtain perfect airtightness.

In addition to the above, each panel has frontal bores 25 and 26, at least on one of the surfaces, together with further bores or ducts which penetrate thereinto from the edges, in correspondence with the middle plane thereof, to cross the previously mentioned bores. These latter bores are not marked in FIGS. 13, 14 and 15, but can be seen clearly in FIGS. 18, 21, 22, 24, 25, 26 and 27. Each pair of complementary bores cross each other within the panel, as shown in the mentioned Figures.

The columns, shown in their different versions in FIGS. 38 to 58, are likewise prefabricated and have lateral grooves 82, 86, 68*a*, etc., specially on the surfaces to be coupled to any one of the plates mentioned hereinbefore, such as, for example, those marked 4.

Furthermore, fastening elements are embedded in the mass of reinforced concrete of the columns, which elements are comprised by rods such as those shown in FIGS. 28 to 31 and marked 71, 76, 77 and 71', being either straight, bent at 90°, T-shaped or cross-shaped, and in all cases having threaded ends 78, said fastening elements being placed in the columns at the same height as bores 25 and 26 provided in the various wall panels, such as, for instance, those marked 2.

The columns further include nuts 72 within the concrete mass and in correspondence with each of the threaded ends of elements 71, 76, 77 and 71', mentioned above, to engage the ends of said elements, with the particularity that said nut 72 is twice the length of the threaded end 78 of the elements, the outer mouth of the nuts 72 being thus completely on a level with the surface of the side wall of the column wherein they are embedded.

The columns are reinforced and may include a middle longitudinal cavity filled with an insulating material 73 for preventing possible thermal conduction between the outside and the inside of the building. This characteristic can be seen clearly in FIGS. 24, 25 and 26, for example.

Each column further has a series of longitudinal grooves on the sides and at the ends thereof, as shown in FIGS. 38 to 58. The purpose of the longitudinal grooves, marked 84 and 85 in FIGS. 24, 25, 26 and 27, for instance, is to house joints 50 and 50*a*, which act together with those of the wall panels or modules. Said grooves have not been marked on the various sections of FIGS. 41, 42, 46, 50, 54 and 56, in order to keep the drawing simple.

Other longitudinal grooves, such as those marked 82 in FIGS. 41 and 42, and 86 in FIG. 46, allow the inclusion of insulating material, such as an expanded material, to increase the efficiency of thermal breakdown together with other grooves in adjacent panels. (see FIGS. 24, 25, 26 and 27).

Other frontal grooves provided on the ends of the columns, such as those marked 83, 86, 87 and 88, are made such that the elevations of the alignment base plates may fit thereinto. See FIGS. 20 and 56, for instance, which show how the U-shaped elevation 21 fits into the grooves 88 of the ends of a panel or column. In the same way, the grooves 87 in FIG. 48 house the elevation 18 of plate 14*a*, shown in FIGS. 6 and 7. Grooves 89 of FIG. 52 house the elevation 16-17 of plate 14, shown in FIGS. 4, 5 and 6, etc.

The above implies that each column is supported on the elevation of one of the plates of FIGS. 4, 7, 9 and 11, and that grooves are provided on the corresponding surface of the column for housing the upper edges of the elevation through insulating joints.

The panels are shown diagramatically in FIGS. 13 to 15 and are marked 2, 3 and 4. They are made of reinforced concrete, the inner cavity being filled with insulating material 28. The edges of the panels are provided with a groove for coupling thereof to the elevations of the plates, to the profiles which rest on said plates, to adjacent panels, to columns, roof panels and possibly to the lower projections of plates constituting an upper web in modular buildings of more than one floor.

FIGS. 16 and 17 show two views of a specific application of the invention. A panel 5 carrying a window 6 rests, for example, on profile 9, and is joined to a roof panel 7 along its upper edge by means of element 44. An inner panel (M) is likewise shown, and rests, for instance, on a profile 11 and on roof panel 7, at the ridge area 35-36-37. Panel 2 is likewise seated on profile 9.

The panels are provided with bores 25–26, which are perpendicular thereto and placed near the edges, forming transversal ducts which penetrate into the panel.

Said ducts are placed at predetermined positions in correspondence with elements 71, 71', 76 and 77 of columns 68, 74, 75, etc., and may either be through ducts, i.e., open on both sides of the panel, or open only on one side thereof.

In addition to such transversal bores, there are provided further bores marked 69 and shown clearly in FIGS. 18, 21, 22 and 24 to 27, perpendicular to the former and on the same plane as the panel, which open towards the edge of said panel and cross and surpass the mentioned transversal ducts.

In order to properly set out the description contained in this specification, FIGS. 21 and 22, which show the lateral coupling of exterior and interior panels, respectively, shall be referred to in the first place.

FIG. 21 shows two adjacent exterior panels 2 and 2' and the bores 25 and 26 leading to the transversal ducts 47. Ducts 69 from the edge of the panel, which cross and pass ducts 47, can likewise be seen. The opposed edges of the two panels 2 and 2' and the corresponding longitudinal grooves 84, 85 and 90, grooves 84 and 85 housing joints 50 and 50*a* and groove 90 housing the expanded material 66 which aids thermal breakdown between the outside and the inside of the prefabricated building, are likewise shown.

The interior panels of the building shown at FIG. 22 obviously do not require the provision of expanded material, and may furthermore be of lesser thickness than the exterior panels, given that the insulating coefficient required therefor is also less, but the internal ducts are the same.

FIGS. 24, 25 and 26 show the coupling between panels and columns, together with the detail of FIG. 27 which shows duct 47 closed to the outer surface of panel 2.

These figures show transverse sections of the coupling between a column and three panels, between two corner panels and between two coplanar panels. A column 68 (FIG. 24), the T-shaped element 71 and nuts 72 thereof being embedded therein, is coupled to each panel 2 with the aid of joints 50 and 50*a*, housed between each panel and the column 68, in addition to grooves 86, provided in both elements for housing the expanded material 73. Elements 71 extend straight towards ducts 69, which duct is crossed by the transversal bore 47 The same occurs in the couplings shown in FIGS. 25 and 26, no further explanations being necessary.

FIG. 23, showing two roof panels 7, shows how said panels form a lower projection or heel 44, and FIG. 18 shows the coupling between a panel 2 and said heel 44, wherein the heel 44 is likewise provided with grooves 67 in correspondence with those provided in panel 2 for housing joints 50, the bores 47 and 69 being likewise shown in both panels.

A panel 2, which rests on the lower plates and profiles mentioned hereinbefore, is coupled to other panels, to the columns and to the roof panel 7 through its upper edge with the aid of all the grooves, joints, expanded material and ducts crossing each other in the panels and in heel 44 of roof panels 7.

One same basic technique is used for establishing the junctions between the several elements, together with the crossed ducts mentioned previously, which technique constitutes one of the essential characteristics of the invention. FIGS. 18, 21 and 22 show the device 45, shown in detail in FIG. 32, the double-thread nut 49, shown in detail in FIGS. 35 and 36, and screws 48 as essential elements. The device 45 comprises a steel bolt or rod, the heads 46 and 46' whereof expand into frustrum-of-the-cone sectors 46*a* and 46'*a*, which bolt is designed to penetrate into the bores 69 until the ends 46 pass the transversal bore of nut 49. Likewise, screws 48 have frustrum-of-the-cone ends, such that after assembling the device and tightening the screws, the internal frustrum-of-the-cone ends of said screws abut the frustrum-of-the-cone sectors 46*a* and 46'*a* of heads 46 and 46 established at the ends of bolt 45, the panels 2 are compressed against each other, holding joints 50 therebetween, as in panels 65 of FIG. 22, whilst in the case of FIG. 18, the weight of the roof serves this same purpose.

With reference to FIGS. 24, 25 and 26, a different embodiment is foreseen for the bolt or fastening device, shown at FIG. 32, and marked 70, said bolt having a single expanded head 71, similar to one of the heads 46' of bolt 45, whereas the other end comprises a threaded sector 79 designed to engage column nut 72 on fastening a panel to said column.

Column nuts 49 are embedded in the panel itself and are already included therein at the end of their manufacturing process. In this respect, and as shown in detail in the perspective of FIG. 37, it has been foreseen that said nuts 49 are integral with a bushing 69' which makes up the actual bore 69 designed to house bolt 45, or bolt 70, where appropriate, and which, as shown, for example, in FIGS. 21 and 22, extends from the site of bores 25 and 26, perpendicular to the panel, to the corresponding edge of said panel.

The fastening devices or bolts 45 and 70 may be standardised to give a single unit for general use. Thus, there may be manufactured only bolts like the one marked 70, and these used indifferently for fastening a panel to a column or for coupling two panels together, two bolts 70, joined by their threaded ends 79 with the aid of a nut similar, for example, to nut 72 used for fastening the bolt 70 to one of the elements or rods 71, 71', 76 or 77 embedded in the column, being used to make up fastening unit 45.

The nut 72 is shown in FIG. 34, and nut 49 with duct 80 for housing bolt 45 or 70 is in turn shown in FIGS. 35 and 36.

The roof panels 7 appear specifically in FIG. 23, which shows two roof panels fastened to each other, and in FIGS. 16 to 19. Each roof panel is comprised by a middle, stepped portion 29, the steppings having rounded edges, and two end flanges 8*a* in correspondence with their longitudinal edges. The lower surface of portion 29 is provided with a heel 44, mentioned hereinbefore, for coupling to the upper edge of an exterior wall panel, and the sides of flanges 8*a* are provided with grooves 67 for housing joints 50 which, on fastening, render the coupling between roof panels airtight.

Panels 7, which in FIG. 23 are cut along their upper line, extend in the mentioned stepped manner to the ridge area, as shown in FIGS. 16 and 17. FIG. 18 shows the provision of one of the transversal bores, provided in walls 41 of each panel 7, which house through-screws and nuts 40 for lateral fastening. Similar bores can be seen in FIG. 19, which shows the ridge area 36 of roof panels 7, the elevations or steppings 35 and 37 thereof being likewise transversally bored and joined by bolt 52*a*-54 and nut 55 through an intermediate resilient element 56, all of which is duly covered by peak 53, wings 53*a* of said peak resting on the middle sectors 29 established between flanges 8*a* of each module.

Said peak is continuous and may be combined with covers, not shown, for every two flanges 8a, for example, of the ridge parts.

FIGS. 59 and 60 show an elevation and upper plan view, respectively, of the gables.

Said gables are comprised by a series of modules 8, as shown in FIG. 1, FIGS. 59 and 60 showing the three modules which, in the preferred embodiment of the invention, make up the gable for one of the slopes of the roof, it being obvious that the number of modules used will depend on the size of the building.

In FIG. 59, each of the modules 8 making up the gable is shown in accordance with a central cross section along lines IV—IV V—V and VI—VI, such that the inner surface of the module, showing grooves 100 for airtight coupling to the roof modules, appears to the left of the lines, and a cross section of the modules along their central plane appears to the right. The outer surface is smooth and the side edges are provided with grooves 91–92 for housing the joints between each gable and the next. Grooves 91 and 92 shown to the left of FIG. 60 establish the airtightness, with the aid of respective neoprene joints, in relation to the central column M. Each gable module 8 has an inner cavity filled with thermo-insulating material 28, the resulting thickness of the wall 101 on either side thereof being minimal.

The gable modules are coupled to roof panels 7 through the previously mentioned grooves 100 provided on the inner surface of each gable module, specifically through the joints established therein. The gable modules 8 are provided with interior projections 97–98, by means of which they are laterally fastened to each other, inner projection 95 for fastening to the central column M, and inner projections 96 on their lower edge for fastening to the exterior wall panels of the building. All of said projections 95-96-97-98 have a structure, based on crossed bores, which is identical to that of the panels and column, coupling of the gable modules to the panels and to the central column being therefore the same as that described for wall panels to columns and roof panels.

The gable module being farthest to the right of FIG. 59, i.e., the lowest part of the roof, is provided with a coupling device 96a by means of which each gable is joined to each one of the corner columns. In this case, the corner columns are provided with an upper bore which extends from the upper surface to a horizontal through bore which, in a manner identical to that of the panels, allows coupling between gable and column.

All of panels 2, 4, 5 (wall panels, door panels and window panels) have transversal bores 47, either blind or not, bores 69 on the side edge and bores 69 on the upper end, as shown, for example, in FIG. 18. A standard panel has four through bores 25–26, thereby establishing the bores on the side edges for receiving the columns and other panels. Two further bores, not marked in FIG. 15, are additionally provided, said bores likewise being either through-bores or blind bores and communicating with another two bores which penetrate thereto from the upper edge of panel 2. All of such bores allow coupling of the wall panels to heels 44 of roof panels 7 and to the gable modules 8, shown in FIGS. 1, 59 and 60.

A standard panel has four bores 25–26, as mentioned above, at a distance of 1 meter from each other and 30 cm from the upper and lower edges, in a panel of height 2.60 meters. Two unmarked bores are additionally provided, the distance between them being of 1 meter, and each being 30 cm from the corners of the panel.

These unmarked bores are provided only on the upper surfaces and edges of the panels, although for a specific application of the invention they could likewise be provided on the lower surfaces and edges.

FIGS. 1, 17 and 19 show the central column M, which crosses the suspended roof 30–31 of the modular building to attain the ridge area 35–37. The suspended roofs 30–31 are arranged in a conventional manner, hanging from the upper roof panels 7 to form an upper chamber in the position of joists 38. This upper chamber is studied, though not claimed, by the invention in the manner to be hereinafter described.

In the standard embodiment of FIGS. 1, 17 and 19, the central column or columns M may be comprised either by a single unit which crosses the suspended roof to attain the ridge, or by two separate units placed one on top of the other and joined, for example, through upper and lower plates and projections. In this case, (FIG. 19), there is provided a column M which is coupled to a T-shaped profile 58, the stem whereof points downwards, through its upper edge, the profile 58 receiving joints 57 which are coupled to joists 38 under the meeting point or aperture of the ridge, at exactly the place whereat joint 56 is located.

As a general rule, all the exterior panels and columns rest on plate elevations and/or on base profiles having a U-shaped section, in order to increase airtightness in these key areas (see FIG. 20). A double joint 60 is thus established on each of the two branches of profile 21, as shown in the figure. In this particular case, the corner column would be of the type marked 74 and shown in FIGS. 38 to 41, and the wall columns would be of the type marked 75a and shown in FIGS. 55 to 58. Similarly. the exterior column, to which is coupled an interior panel, would be of the type marked 68 in FIGS. 43 to 46 and 68a in FIGS. 51 to 54.

On the other hand, the interior columns and panels 65 rest preferrably on plate elevations and profiles having a T-shaped section 11, with the stem pointing upwards, as airtightness is ensured with a single joint by reason of the panels being inside the building (see FIGS. 16 and 17).

However, it should be emphasized that this is an optional arrangement, for obviously all profiles used could be the same, having either a U-shaped or a T-shaped section, or could be modified with respect to the embodiment described herein.

The panels may be of the same or of different thicknesses. The use of identical panels results in a perfectly modular building. However, the use of thinner interior panels as compared to the exterior panels would result in a substantial reduction in the cost of the building.

In general, and as has already been mentioned hereinbefore, the panels may have a blind surface (see FIG. 27), i.e., duct 47 may not penetrate to the exterior surface thereof.

When this is not so, i.e. when duct 47 is a through-duct, outer closing elements must be provided, which elements are not shown by reason of the fact that any suitable device currently on the market may be used.

A further advantage of the invention which can be inferred from the structure described is that water pipes, tubes for electrical wiring and TV cables, etc., may be set up in the cavities of the panels, using, for instance, the actual ducts established between the panels. These auxiliary ducts may leave the panels at desired positions.

All such pipes and tubing could obviously be placed outside the panels, if deemed more convenient.

With respect to reference 50a in FIGS. 24 to 26, it should here be emphasized that it refers to a specific joint which serves a double purpose and is comprised by a longitudinal sheet, housed in grooves 85, which bends under the effect of the pressure between the panels, or between a panel and a column.

One of the purposes of said joint 50a is to protect the inner joint 50, and another is to allow a certain amount of ventilation to preserve said joint and to facilitate ventilation.

With reference to FIG. 42, it should be pointed out that the special section shown thereat corresponds to the initial, and obviously the end, column of the perimeter of the modular building. On closing said perimeter, the panel to be coupled to said column would prevent the free penetration of fastening device 70 into both panel and column. Through-holes N are therefore provided, to allow insertion of said device from the outside and subsequent sealing of the assembly.

A final characteristic of the invention relates to the ventilation of the building, i.e., to the air ducts and passages which allow the building to be lived in. Special joints 50a between the panels, as mentioned before, are provided, at least partially, for this purpose. The air from the floor of the modular construction in FIG. 1 naturally rises towards the roof, which must be internally provided with suitable ventilation means.

FIG. 19 shows a central separation between the ends of ridges 35 and 37. FIG. 23 further shows a spacing between wing 39 of roof panel 7 and heel 44, to which is coupled a wall panel 2, 4 or 6. Heel 44 is provided with an unmarked bore, which crosses same, thereby establishing a passage through which air entering from the outside may reach the upper chamber. Once in said chamber, the air passes through the mentioned spacings, is evacuated up and out through the spacings established between the joints 57 provided on joists 38 of FIG. 17, and from there to the outside, under part 53 shown in FIG. 19.

In accordance with a possible embodiment of the invention, a band element 103 of reinforced concrete is provided between the exterior walls of the building, comprised by panels 2, 4 and 5, and the roof thereof, comprised by modules 7, which band can be straight, as in FIG. 61, or L-shaped 103' as in FIG. 62, and has a shallow channel 104 of rectangular section on its lower side, the width of said channel being equal to that of the exterior wall modules 2, 4 and 5, the upper edge whereof fits into channel 104, as shown in detail in FIG. 64, said channel 104 further including small grooves 105 which are complementary to those provided on the upper edge of the actual wall panels 2, 4 and 5 and are designed to house and deform the corresponding air-tight joints 106 after coupling.

The band 103 had, on its inner surface and as a further essential characteristic, a large stepping 107 which affects it mainly with respect to its height and which defines a ledge for the coupling, and specifically for supporting, the end areas of modules 108 which constitute a finishing element established in the building, at a level with roof 7.

Each band module 103 additionally includes a further stepping 109 on its upper base, similar to the lower channel 104 but open internally, which is likewise provided with grooves 110, the stepping being designed to receive the heel 111 of roof modules 7, in such a way that the grooves 110 of the band are operatively opposed to those provided in the lower free edge of the heel 111, allowing the coupling and deformation of joints 112, which are similar to those mentioned previously and marked 106.

Coupling of the band modules 103 to the exterior wall modules 2, 4, 5 is effected simultaneously to the coupling of the roof modules 7, the latter including, on their lower edge, a preferrably inverted V-shaped metal profile 113 with a considerably narrowed mouth, as shown in detail in FIG. 64, said profile being designed to house, with a possibility of longitudinal displacement, nut 114 which engages threaded end 115 of a screw or bolt 116 which crosses the band module 103 through bore 117 operatively made therein and penetrates into wall panel 2-4-5 through the vertical, coplanar bore 117 provided in said module in correspondence with each of the bores 117 provided in the band module, to cross the transversal bore 118 wherein is housed setscrew 119, having a frustrum-of-the-cone front and which, on being actuated, affects the likewise frunstrum-of-the-cone sector 120 of the expanded head 121 of bolt 116, in a manner similar to that of the lateral coupling between wall panels, or between a panel and a column, in the structure described hereinbefore.

Turning once again to finishing modules 108, these are comprised by a thin laminar body 108 provided with a short perimetral flange 122, being vertical and ascending, which stiffens the structure thereof, with the aid of intermediate and transversal walls 123, which are likewise shown in FIG. 64, with the particularity that the perimetral flange 122 of said finishing modules is considerably higher than stepping 107 provided in the band modules, wherefore said finishing modules 108 work together with the band modules to inwardly close the stepping 109 provided in the latter and to form a channel similar to the one provided on the lower base thereof, marked 104, this being of greater importance in buildings having more than one floor, in which case the finishing modules aid the correct coupling of the exterior wall panels of the upper floor.

The perimetral flange 122 of said finishing elements 108 are provided, preferrably between the two stiffening walls 123 with bores 124, for lateral coupling between said modules, with the aid of through-screws and respective nuts, the finishing elements being furthermore provided with end bores 125 for coupling to the band modules 103 with the aid of screws 126 and nuts 127, the latter being embedded in the band modules.

It should be pointed out, finally, that roof panels 7 are practically identical in structure to the finishing modules 108, the only difference being the provision of the heel 111 through which the roof panels rest on, and are coupled and fastened to, exterior wall modules 2-4-5, with the insertion therebetween of band module 103.

Lastly, and referring once again to band module 103, it should likewise be pointed out that said modules include a small groove 128, as shown in FIG. 63, at the edge of the channel or stepping 109, wherein are coupled the heels 111 of roof modules 7, or the exterior walls of an upper floor, which groove acts as a collector for rainwater, water due to condensation, etc., and communicates with the front lower area of band module 103 through ducts 129 being suitably distributed along the band modules and which obviously drain said water to the outside of the exterior wall panels 2-4-5.

Means for arranging finishing elements are thus available to the modular structure, specially through band modules 103, together with an ornamental finish which improves the aesthetic appearance of the building.

It is not considered necessary to extend the present description any further for a person skilled in the art to understand the scope thereof and the advantages derived therefrom.

The materials, shape, size and arrangement of the elements may vary, provided they do not imply a modification to the essentiality of the invention.

The terms used in this Specification should be taken to have a wide and non limited meaning.

I claim:

1. A modular structure for a prefabricated building, comprising:

at least two slab-shaped modules, each module having opposite generally-planar faces and edges therebetween, correspondingly-positioned blind bores opening perpendicularly into the edges and at least one other bore opening perpendicularly into at least one of the generally-planar faces of the module from each blind bore;

support means adjustably supporting the modules with an edge of one module juxtaposed with an edge of another module for opposing at least some of the blind bores thereof, whereby the modules may be coupled at the thereby-coupling, juxtaposed edges;

fasteners, each expanding with diverging frustrum-of-the-cone sectors into heads at opposite ends thereof, respectively in at least some of the opposing blind bores with the heads thereof respectively surpassing slightly the axes of the other bores opening from blind bores the fasteners are in; and setscrew means respectively in the other bores, each setscrew measn comprising a setscrew having a frustrum-of-the-cone front end in the other bore and abutting means for abuttlingly affecting the frustrum-of-the-cone sector of the fastener in the blind bore from which the other bore with the setscrew opens with the end of the setscrew, whereby to couple between the coupling edges of the juxtaposed modules.

2. The modular structure of claim 1, and further comprising sealing means for sealing the other bores.

3. The modular structure of claim 2, wherein each of the abutting means comprises a nut held in each other bore for cooperative engagement with the setscrew, whereby to force the modules together tightly.

4. The modular structure of claim 1, wherein each of the abutting means comprises a nut held in each other bore for cooperative engagement with the setscrew, whereby to force the modules together tightly.

5. The modular structure, of claim 4, wherein each of the abutting means further comprises a single-block bushing in the other bore thereof for holding therein the setscrew thereof.

6. The modular structure of claim 1, wherein the other bores open into only one of the faces of the module thereof.

7. The modular structure of claim 1, and further comprising: a column; elements having at least two arms with threaded ends embedded in the column so that the threaded ends correspond to the blind bores opening into one edge of the modules; nuts respectively on the threaded ends of the elements and embedded in the column so that the outermore mouth of the nut is flush with a surface of the column; and other fasteners, each other fastener having a threaded sector on one end for engagement with the nuts and a frustrum-of-the-cone sector expanding the opposite end to a head for being within the blind bores opening into the one edge of the one of the modules and abutting affect from the setscrews in the other bores opening therefrom, whereby to couple the one module to the column.

8. The modular structure of claim 1, and further comprising: a roof module having a heel having a bottom for support from an upper one of the edges of at least one module; and bottom blind bores opening into the bottom correspondingly to the blind bores opening into the one, upper edge of the at least one module for fasteners to the at least one module.

9. The modular structure of claim 8, wherein the roof module further comprises sections stepped parallel to the heel and flat-faced side flanges transverse to the steps of the sections and the heel for lateral coupling therebetween; and further comprising through-screws for the lateral coupling between the roof sections.

10. The modular structure of claim 8, and further comprising: an elevation along an edge of the roof section shaped, spaced from and parallel to the heel for sloping the roof section from a ridge thereat when in cooperative abutment with the elevation of a complementary roof section; through-screws and respective nuts therefor extending from the elevation for connection to the complementary roof section; and an upper peak member for running along at least the elevation projecting transversely therefrom, whereby to and cover at least the abutment thereof with the complementary roof section.

11. The modular structure of claim 8, wherein some of the modules extend transversely to the heel of the roof module under the roof module; and further comprising gable modules for forming a gable between the some modules and the roof module, the roof module having blind bores along the gable modules and the gable modules having corresponding blind bores and blind bores in one edge corresponding to blind bores in an edge of the some modules, the latter blind bores having another bore opening transversely therefrom, whereby to receive, respectively, some of the fasteners.

12. The modular structure of claim 8, and further comprising: a band element between the bottom of the heel of the roof module and the one, upper edge of the at least one module; a channel on one, first side of the band element for receiving the one, upper edge of the at least one module; a step on a second side of the band element opposite the first side thereof for engaging the roof module; and a step on a third side of the band element between the first and second sides thereof, whereby to support a finishing module extending to an opposed band element.

13. The modular structure of claim 12, and further comprising: still other fasteners extending from the bottom blind bore of the bottom of the heel of the roof module for receipt in respectively corresponding blind bores opening into the one, edge of the at least one module, each still other fastener having threads at one end and a diverging frustrum-of-the-cone sector expanding the opposite end into a head for receipt in one of the blind bores opening into the one, upper edge of the at least one module; bores through the band element for respectively passing the still other fasteners; means in the heel of the roof sector for respectively receiving the threads at the one ends of the still other fasteners; grooves respectively in the bottom of the lower heel of the roof module and the second side of the band element, and the channel on the first side of the band element and the one, upper edge of the at least one module respectively opposing each other for housing respective airtight joints.

14. The modular structure of claim 12, and further comprising nuts embedded in the band module and a finishing module for support form the step on the third side of the band element, each of the roof and finishing modules comprising: a sheet having a perimetral flange extending form and about one side, the opposite side of the sheet being flat; a pair of transversal walls between opposite portions of the perimetral flange; a first bore through each of the opposite portions of the perimetral flange between the transversal walls for a through screw coupling the module to another, like module; joint means for an airtight joint about the perimetral flange; a second bore through each of other opposite portions of the perimetral flange transverse to the opposite portions having the first bores; and a screw through one of the second bores for engaging the nut embedded in the band element.

15. The modular structure of claim 14, wherein the perimetral flange about the finishing module extends from the one side thereof farther than the distance from the step on the third side of the band element to the second side of the latter, whereby to define a channel between a portion of the perimetral flange and the step on the second side of the band element when the finishing module is on the step of the third side of the band element for receiving the heel of the roof module; and further comprising a channel along the second side of the band element and drain bores distributed along the channel and communicating therefrom to a fourth side of the band element opposite the third side thereof.

16. The modular structure of claim 1, wherein the support means comprises: metal plates; means for adjustably leveling the metal plates with respect to each other; and metal profiles of at least one of a U and inverted T shape to have at least one free end projecting therefrom, the metal profiles being across the metal plates with the free end thereof most remote from the metal plates for supporting the modules.

17. The modular structure of claim 16, wherein the modules further comprise a groove or grooves in at least one of the edges for respectively receiving each free end of the metal profiles when the modules are supported thereon.

18. The modular structure of claim 1, and further comprising: at least one groove along the coupling edge of each module opposing the groove in the coupling edge of the other module when juxtaposed therewith for defining a channel between the modules; and an expanding insulating material for expanding and filling the channel when defined.

* * * * *